US012241253B2

(12) United States Patent
Koester

(10) Patent No.: US 12,241,253 B2
(45) Date of Patent: Mar. 4, 2025

(54) COMBINATION RAINSCREEN/LATH ASSEMBLY AND METHOD OF INSTALLING SAME

(71) Applicant: Masonry Technology, Inc., Cresco, IA (US)

(72) Inventor: John H. Koester, Payson, AZ (US)

(73) Assignee: Masonry Technology, Inc., Cresco, IA (US)

( * ) Notice: Subject to any disclaimer, the term of this patent is extended or adjusted under 35 U.S.C. 154(b) by 105 days.

(21) Appl. No.: 17/915,016

(22) PCT Filed: Mar. 23, 2021

(86) PCT No.: PCT/US2021/023612
§ 371 (c)(1),
(2) Date: Sep. 27, 2022

(87) PCT Pub. No.: WO2021/202161
PCT Pub. Date: Oct. 7, 2021

(65) Prior Publication Data

US 2023/0151615 A1 May 18, 2023

Related U.S. Application Data

(60) Provisional application No. 63/023,480, filed on May 12, 2020, provisional application No. 63/001,846, filed on Mar. 30, 2020.

(51) Int. Cl.
*E04F 13/04* (2006.01)

(52) U.S. Cl.
CPC ..... *E04F 13/047* (2013.01)

(58) Field of Classification Search
CPC ..... E04B 1/625; E04B 1/7069; E04F 13/047
USPC ..... 52/302.3
See application file for complete search history.

(56) References Cited

U.S. PATENT DOCUMENTS 1,802,779 A * 4/1931 Quade ..... E04F 13/04 52/454
2,212,126 A * 8/1940 Phillips ..... E04F 13/045 52/363
3,888,087 A * 6/1975 Bergsland ..... E02D 31/02 405/36
4,381,630 A * 5/1983 Koester ..... E04B 1/7023 D25/155
4,795,562 A * 1/1989 Walsh ..... G01N 33/54366 210/232
5,099,627 A * 3/1992 Coulton ..... E04D 12/002 52/518
5,224,316 A * 7/1993 Fredericks ..... E04F 13/04 52/309.7

(Continued)

OTHER PUBLICATIONS

International Search Report and Written Opinion from PCT/US21/23612; Lee Young; 12 pages; Jun. 8, 2021.

(Continued)

*Primary Examiner* — James M Ference
(74) *Attorney, Agent, or Firm* — Dicke, Billig & Czaja, PLLC

(57) ABSTRACT

A combination rainscreen/lath assembly comprises a corrugated spunbond layer and a lath layer operatively connected to the corrugated spunbond layer. Optionally, the lath layer is corrugated. The assembly is configured and arranged to allow air and moisture to flow therethrough.

10 Claims, 26 Drawing Sheets

(56) References Cited

U.S. PATENT DOCUMENTS 6,131,353 A * 10/2000 Egan ..... B32B 7/14 52/309.1
6,298,620 B1 * 10/2001 Hatzinikolas ..... E04F 13/0869 52/302.1
6,355,333 B1 * 3/2002 Waggoner ..... E04B 1/62 52/630
6,594,965 B2 * 7/2003 Coulton ..... E04B 1/7046 52/302.1
6,883,284 B1 * 4/2005 Burgunder ..... E04F 17/00 52/302.1
6,964,136 B2 * 11/2005 Collins ..... E04B 1/70 52/302.1
6,990,775 B2 * 1/2006 Koester ..... E04B 1/70 52/783.17
7,625,827 B2 * 12/2009 Egan ..... E04F 13/04 52/408
7,632,763 B2 12/2009 Newton et al.
7,699,949 B2 4/2010 Newton et al.
7,786,026 B2 8/2010 Newton et al.
7,867,350 B2 1/2011 Newton et al.
7,902,092 B2 3/2011 Egan et al.
8,187,401 B2 5/2012 Newton et al.
8,298,967 B2 10/2012 Egan et al.
8,631,615 B2 * 1/2014 Carbonaro ..... E04H 9/14 52/506.05
8,734,932 B2 * 5/2014 Keene ..... D04H 3/16 428/218
8,910,436 B2 * 12/2014 Carbonaro ..... E04B 1/26 52/506.05
9,145,688 B2 * 9/2015 Hunt-Hansen ..... E04F 13/0803
9,783,980 B2 * 10/2017 Snyder ..... E04B 1/625
10,125,489 B2 * 11/2018 Snyder ..... B32B 5/028
10,196,812 B1 * 2/2019 Duffy ..... E04F 13/007
10,822,791 B2 * 11/2020 Hoggatt ..... E04C 2/526
2003/0037499 A1 * 2/2003 Coulton ..... E04B 1/7612 52/309.1
2004/0255533 A1 * 12/2004 Koester ..... E04B 1/70 52/302.1
2006/0117686 A1 * 6/2006 Mankell ..... E04D 13/1625 52/302.1
2006/0281379 A1 * 12/2006 Haas ..... E04D 12/002 442/79
2006/0286347 A1 * 12/2006 Mehta ..... B32B 3/266 428/137
2007/0051069 A1 * 3/2007 Grimes ..... E04F 13/04 52/506.01
2008/0260993 A1 * 10/2008 Koester ..... E04F 13/047 52/302.1
2009/0158683 A1 * 6/2009 Weston ..... E04B 1/625 52/411
2010/0000665 A1 * 1/2010 Newton ..... D03D 19/00 156/229
2010/0043307 A1 * 2/2010 Koester ..... E04F 13/06 52/364
2010/0043326 A1 * 2/2010 Koester ..... E06B 1/62 52/302.1
2010/0101159 A1 * 4/2010 Gleeson ..... E04B 2/707 52/302.1
2010/0236158 A1 * 9/2010 Carbonaro ..... E04H 9/14 52/712
2012/0183744 A1 * 7/2012 Keene ..... E02D 31/02 428/175
2012/0183746 A1 * 7/2012 Keene ..... B32B 3/06 428/218
2012/0247040 A1 * 10/2012 Buoni ..... E04F 13/04 52/302.1
2012/0304565 A1 * 12/2012 Hines ..... E04F 13/007 52/302.1
2013/0276392 A1 * 10/2013 Johnson ..... E04F 13/047 52/302.1
2017/0037637 A1 * 2/2017 Grisolia ..... B32B 21/02
2018/0209140 A1 * 7/2018 Hoggatt ..... E04B 1/70
2020/0340238 A1 * 10/2020 Johnson ..... E04C 2/46
2020/0354965 A1 * 11/2020 Attebery, II ..... B32B 3/266
2021/0404177 A1 * 12/2021 Koester ..... E04F 13/04
2023/0151615 A1 * 5/2023 Koester ..... E04B 1/7069 52/302.3

OTHER PUBLICATIONS

Masonry Technology Incorporated; Building Moisture Management Solutions, Mar. 2019; 52 pages.
Dorken; Delta-Dry & Lath Technical Data Sheet; 1 page; 2019.
Delta; Dorken Systems Inc.; Delta—Dry & Lath product brochure; 4 pages; known of prior to Nov. 29, 2018.
US Fabrics; DuPont Spunbond Nonwoven Geotextiles; 3 pages; https://www.usfabricsinc.com/products/dupont-spunbond-nonwoven-geotextiles/; accessed Mar. 19, 2020.
Delta; Dorken Systems Inc.; Delta—Dry & Lath Installation Instructions; 3 pages; Apr. 11, 2019.
Tamlyn; XtremeEnvelope Solutions; Tamlyn Water Management System Product & Technical Guide; 32 Pages; 2016.
Masonry Technology Incorporated; Corrugated Lath Strip brochure; Mar. 2019; 2 pages.
Typar; Geotextiles Product Overview; 12 pages; TGT01; Aug. 2012.
avintiv.com; Typar Spunbond Polypropylene; http://www.technicalnonwovens.com/product/typar-spunbond-polypropylene; accessed Mar. 19, 2020; 2 pages.
Benjamin Obdyke; Cedar Breather Installation Instructions; 10 pages; 2017.
Adfors Saint-Gobain; FibaLath Installation Instructions; 1 page; Apr. 2019.
Adfors Saint-Gobain; FibaLath Sell Sheet; 2 pages; Apr. 2018.
ICC Evaluation Service; New Fiber Stucco Lath Creates Industry Buzz; 2 pages; Oct. 2008.
Amico; Hydrodry Moisture Management Solution brochure; 8 pages; date of brochure unknown; HYDRODRY trademark registration date of first use Jul. 31, 2019.
Coravent Incorporated; Cor-A-Vent's Siding Vent System: Your Rainscreen Ventilation Solution brochure; 12 pages; Jun. 2015.
Risinger, Matt; Keep it Dry: How to Manage Moisture with Rainscreens; Builder Online; 3 pages; posted on Jun. 25, 2015; accesed at https://www.builderonline.com/building/building-science/keep-it-dry-how-to-manage-moisture-with-rainscreens_s?o=0 on Apr. 30, 2021.
Master Wall Inc.; Fibalath product data sheet; rev 190101; 2019; 2 pages.
Adfors; Fibalath product overview; known of prior to Mar. 30, 2020; accessed at https://us.adfors.com/facade-reinforcement-mesh/fibalath on Jun. 3, 2022; 2 pages.
Adfors; Industrial Fabrics brochure; Sep. 2018; 2 pages.
BASF Wall Systems; PermaLath 1000 Product Bulletin 1032008; 2007; 4 pages.
Master Builders Solutions; PermaLath 1000 Product Bulletin; known of prior to Mar. 30, 2020; Apr. 2021; 3 pages.
Master Builders Solutions; PermaLath 1000 Test Results Technical Bulletin; known of prior to Mar. 30, 2020; Feb. 2022; 2 pages.
BASF; PermaLath 1000 Product Bulletin rev 180808; 4 pages; 2018.
BASF; Senergy Sentry Stucco Ultra Wall System System Overview rev 150120; 4 pages; 2015.
Intertek; Code Compliance Research Report CCRR0249; 9 pages; known of prior to Mar. 30, 2020; Renewal Date Jun. 30, 2021.

* cited by examiner

COMBINATION RAINSCREEN/LATH ASSEMBLY AND METHOD OF INSTALLING SAME

CROSS-REFERENCE TO RELATED APPLICATIONS

This application is a national phase application of International Application No. PCT/US2021/023612, filed Mar. 23, 2021, which claims the benefit of U.S. Provisional Application Ser. No. 63/001,846, filed Mar. 30, 2020, and U.S. Provisional Application Ser. No. 63/023,480, filed May 12, 2020, which are incorporated in their entirety herein by reference.

BACKGROUND

Developments in the construction of buildings have generally resulted in "tighter" buildings, meaning there is less airflow and moisture leakage between the interior and exterior of the buildings. As a result, "tighter" buildings have an increased risk for moisture and mold problems. Known rainscreen systems reduce the risk of moisture and mold damage by enabling moisture that has penetrated an exterior building envelope material to swiftly exit the building envelope. However, known rainscreen systems commonly form a moisture barrier, which can cause moisture accumulation and make it difficult for moisture to dry.

For the reasons stated above and for other reasons stated below, which will become apparent to those skilled in the art upon reading and understanding the present specification, there is a need in the art for a combination rainscreen/lath assembly and a method of installing the assembly.

SUMMARY

The above-mentioned problems associated with prior devices are addressed by embodiments of the disclosure and will be understood by reading and understanding the present specification. The following summary is made by way of example and not by way of limitation. It is merely provided to aid in understanding some of the aspects of the invention.

In one embodiment, a combination rainscreen/lath assembly comprises a corrugated spunbond layer and a lath layer operatively connected to the corrugated spunbond layer. The assembly is configured and arranged to allow air and moisture to flow therethrough.

In one embodiment method of installing a first combination rainscreen/lath assembly and a second combination rainscreen/lath assembly onto a wall, the first combination rainscreen/lath assembly and the second combination rainscreen/lath assembly are provided. The first combination rainscreen/lath assembly is positioned on the wall with a first corrugated spunbond layer facing toward the wall, a first lath layer facing away from the wall, and a first skirt portion of the first lath layer extending downward beyond the first corrugated spunbond layer. The first combination rainscreen/lath assembly is fastened to the wall. The second combination rainscreen/lath assembly is positioned on the wall above the first combination rainscreen/lath assembly with a second corrugated spunbond layer facing toward the wall, a second lath layer facing away from the wall, and a second skirt portion of the second lath layer extending downward beyond the second corrugated spunbond layer. A bottom of the second corrugated spunbond layer is aligned with a top of the first corrugated spunbond layer, the second skirt portion is overlapped on the first lath layer, and the second combination rainscreen/lath assembly is fastened to the wall.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. In accordance with common practice, the various described features are not drawn to scale but are drawn to emphasize specific features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that other embodiments may be utilized and mechanical changes may be made without departing from the spirit and scope of the present disclosure. The following detailed description is, therefore, not to be taken in a limiting sense.

Generally, embodiments of this disclosure relate to a combination lath and rainscreen provided in a single assembly and to methods of installation. Various embodiments simplify installation thereby reducing labor costs and installation requirements. In addition, various embodiments are non-corrosive and are metal-free. Advantages of being metal-free include reduced weight, reduced cost, safer handling, and less interference with radio frequency signals.

Figure 3:
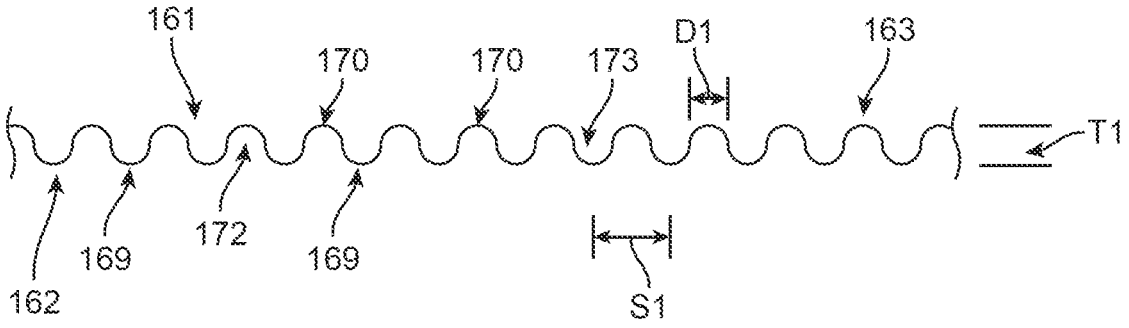
FIG. 3 is a side view of another embodiment spunbond layer of a combination rainscreen/lath assembly that has been corrugated and constructed in accordance with the principles of the present invention.

An example combination lath and rainscreen assembly generally includes two layers. One layer is a rainscreen layer preferably made of spunbond, which is preferably made of polypropylene. Preferably, the spunbond has a sheet thickness of 0.020 to 0.030 gauge. The spunbond is crimped or folded to form corrugated spunbond having grooves or ridges. For example, as shown in FIG. 3, spunbond 161 has been crimped to form outwardly extending portions 169 proximate a front side 162 and inwardly extending portions 170 proximate a rear side 163 thereby forming outwardly facing cavities 172 and inwardly facing cavities 173. For example, the portions 169 and 170 can have ¼ to ½ inch (preferably 5/16 inch) diameters D1 and the peaks of adjacent portions 169 and adjacent portions 170 can be spaced (spaces S1) ¼ to ½ inch (preferably ⅝ inch) apart so the corrugated spunbond's thickness T1 is ¼ to ¾ inch (preferably 5/16 inch). Any suitable crimping or folding technique can be used.

Figure 1:
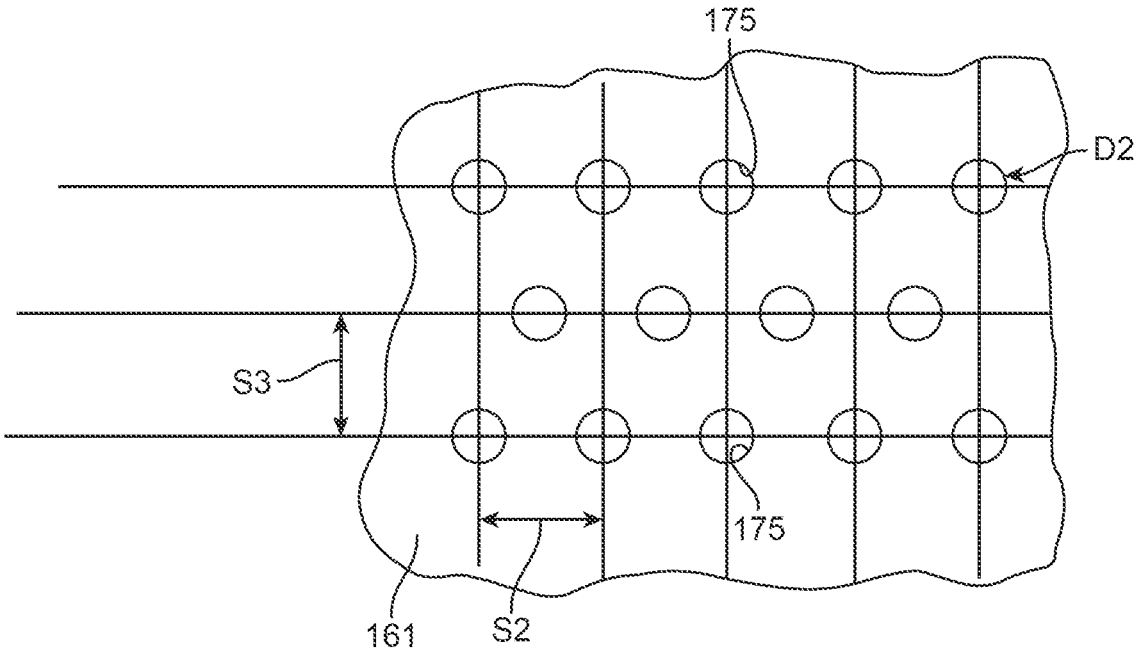
FIG. 1 is a front view of an embodiment spunbond layer of a combination rainscreen/lath assembly that has been perforated and constructed in accordance with the principles of the present invention.
Figure 2:
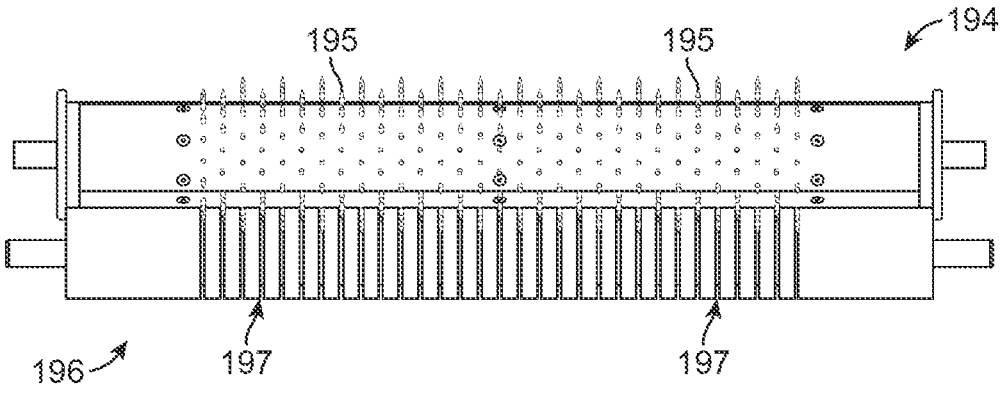
FIG. 2 is a perspective view of a roller assembly for perforating the spunbond layer shown in FIG. 1.
Figure 4:
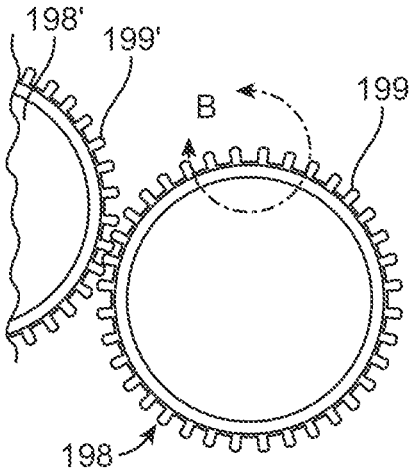
FIG. 4 is a side view of a roller assembly for corrugating the spunbond layer shown in FIG. 3.
Figure 5:
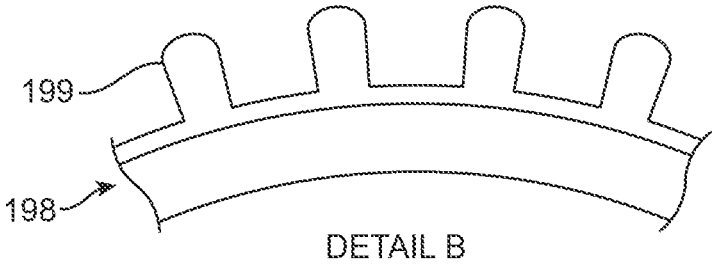
FIG. 5 is a detail view of a portion of a roller shown in FIG. 4.

For example, as shown in FIGS. 4 and 5, crimping can be accomplished by inserting the spunbond between rollers 198 and 198' including mating protrusions 199 and 199'. The spunbond can optionally be perforated prior to crimping. For example, as shown in FIG. 1, perforations 175 can be formed in the spunbond 161 in a staggered pattern and each perforation having a ¼ to ½ inch (preferably 5/16 inch) diameter D2 with the centers generally spaced (spaces S2, S3) ½ inch to 1 inch (preferably ¾ inch) apart. Any suitable perforation technique can be used. For example, as shown in FIG. 2, perforation can be accomplished by inserting the spunbond between two rollers, a perforating roller 194 having a plurality of outwardly extending pins 195 configured and arranged to pierce the spunbond and a roller 196 having slots 197 configured and arranged to receive the pins 195 as they extend through the spunbond. The perforations can be any suitable size, any suitable shape, and arranged in any suitable pattern. The assembly can include spunbond without perforations, spunbond with perforations, or spunbond alternating between no perforations and perforations. The alternating no perforations and perforations can be on the same sheet or with alternating sheets of spunbond.

Figure 31:
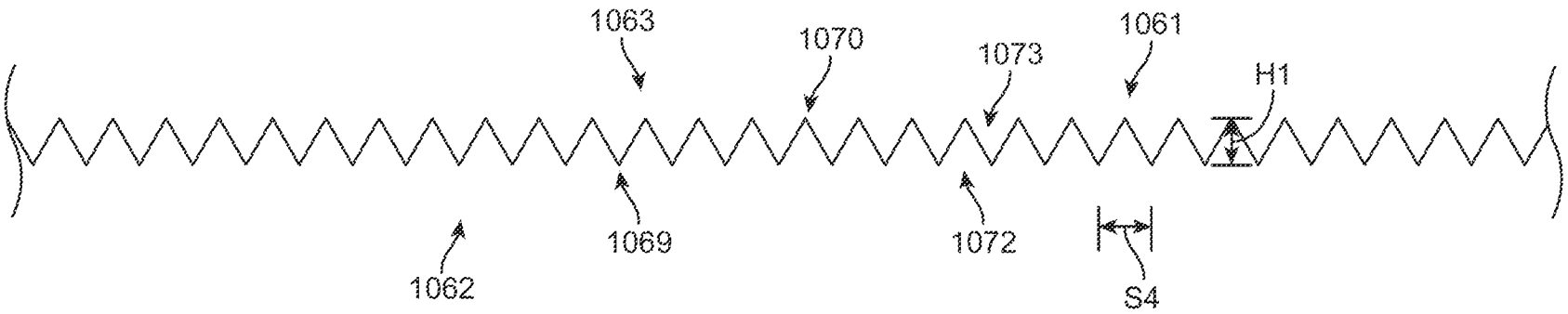
FIG. 31 is a side view of another embodiment spunbond layer of a combination rainscreen/lath assembly that has been corrugated and constructed in accordance with the principles of the present invention.
Figure 32:
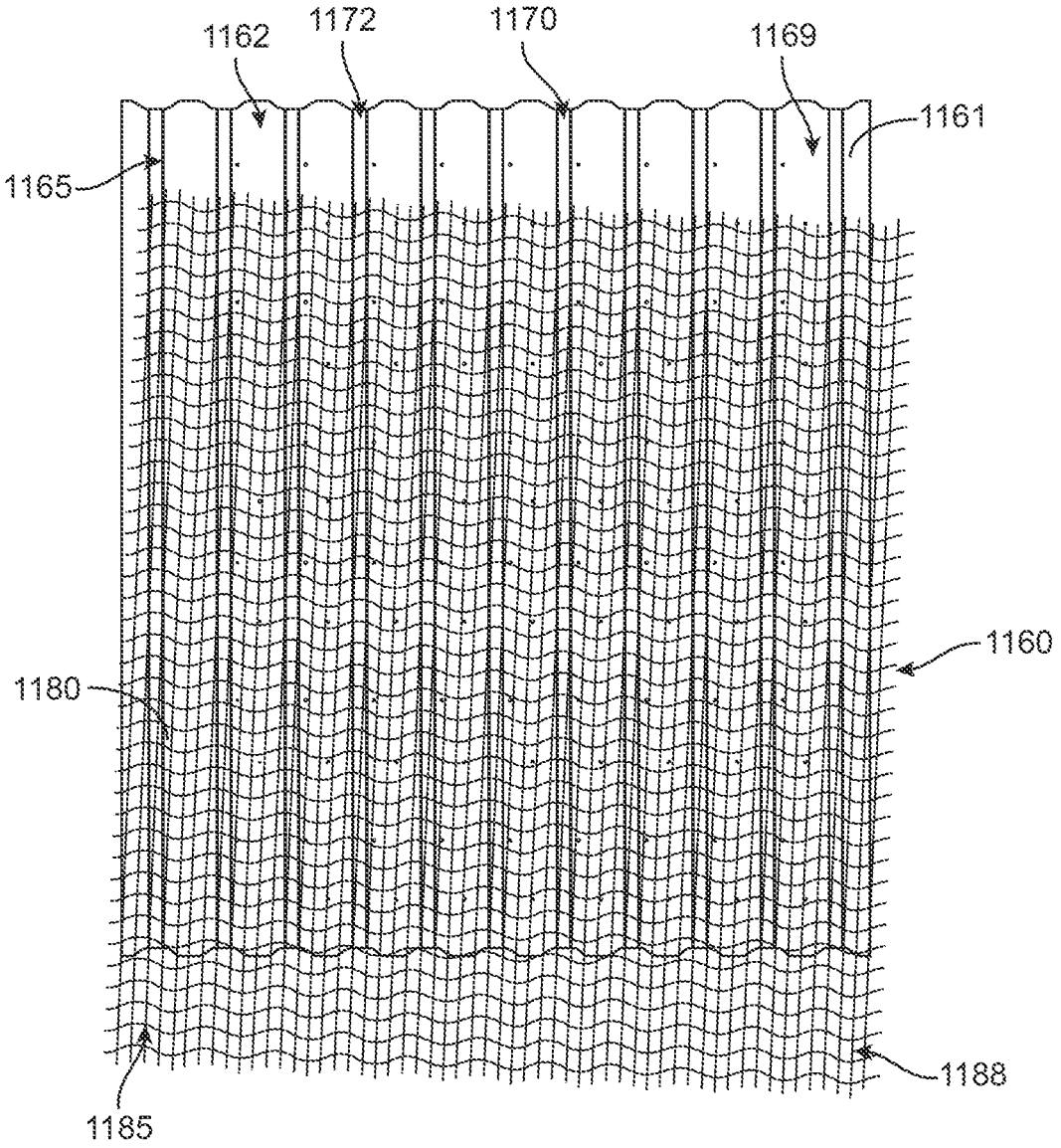
FIG. 32 is a front view of another embodiment combination rainscreen/lath assembly constructed in accordance with the principles of the present invention.
Figure 33:
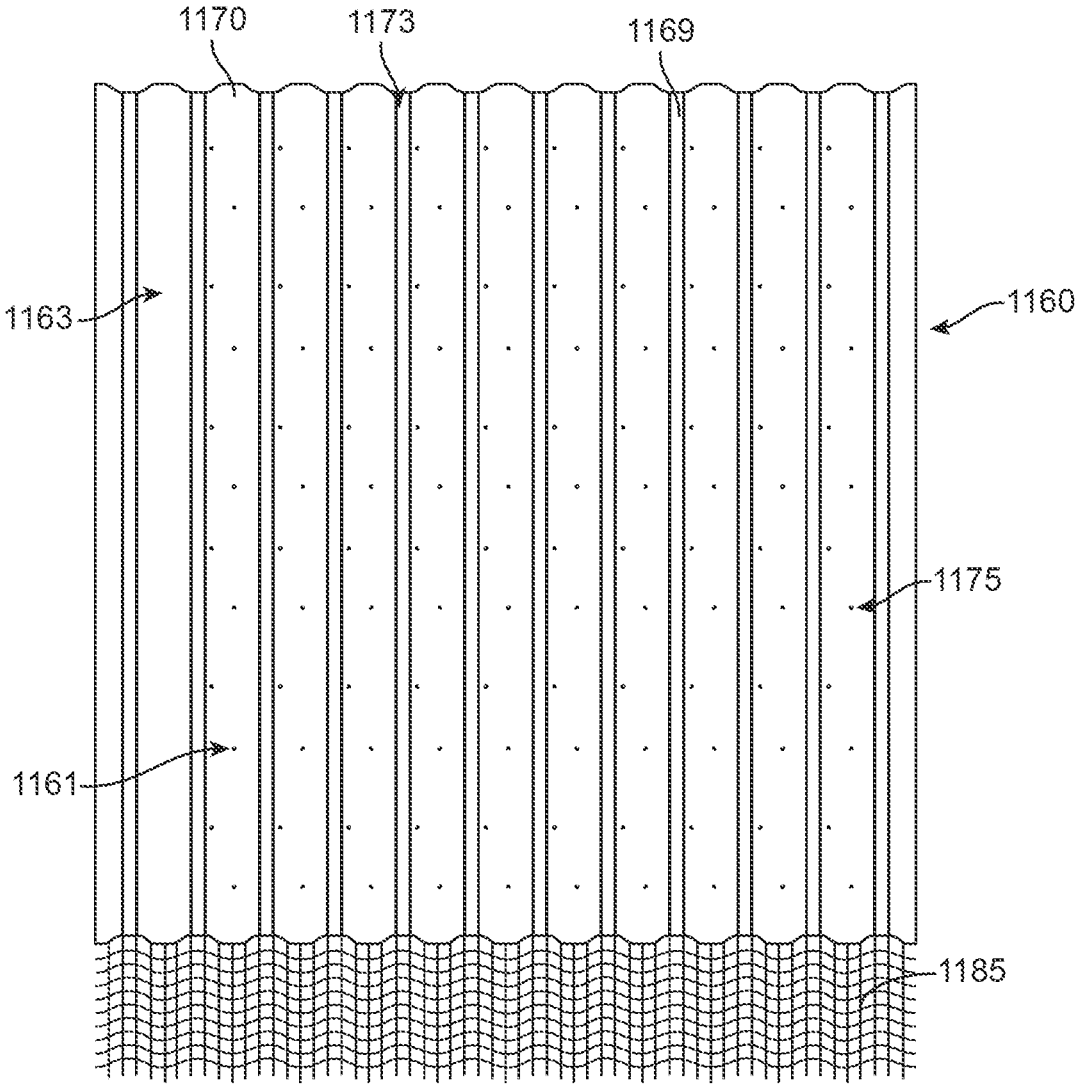
FIG. 33 is a rear view of the combination rainscreen/lath assembly of FIG. 32.

Another example spunbond 1061 is shown in FIG. 31. Spunbond 1061 has been folded to form outwardly extending portions 1069 proximate a front side 1062 and inwardly extending portions 1070 proximate a rear side 1063 thereby forming outwardly facing cavities 1072 and inwardly facing cavities 1073. For example, the spunbond 1061 can be folded to have a height H1 of ¼ to ¾ inch (preferably ⅜ inch) with a space S4 of ¼ to ¾ inch (preferably ⅜ inch) between adjacent peaks of the outwardly and inwardly extending portions. Any suitable folding technique can be used.

The spunbond preferably does not form a moisture barrier, especially if perforated, thereby allowing air and moisture to move through and dry any moisture proximate the spunbond, however, areas that are not perforated also act as drainage planes. Because the spunbond acts as a rainscreen, moisture does not accumulate because it drains out along the rainscreen and through the bottom void. Vertical orientation of the spunbond's outwardly and inwardly extending portions assists in drainage. Due to its corrugation, air gaps are formed on both sides of the spunbond thereby allowing air to flow through both sides of the spunbond.

The other layer is a lath layer preferably made of a scrim material, which is made of a fiberglass material with an alkaline resistant coating suitable for a fire rating. Preferably, the scrim material has a thickness of 0.025 to 0.035 gauge. The lath layer is operatively connected to the spunbond layer by any suitable attachment means including but not limited to an adhesive, a fastener, or stitching. The scrim material includes a plurality of voids or apertures configured and arranged to receive scratch coat and is preferably a heavier weight than typical scrim material to better support and secure the scratch coat. When scratch coat is applied onto the lath, some of the scratch coat extends through the voids or apertures in the lath and can enter the outward facing cavities and the perforations of the spunbond thereby providing additional adherence or bonding. The term "scrim material" used throughout can be substituted with a suitable lath layer material.

Advantages of the assembly include that it is flexible (e.g., it is easy to roll and transport), it is lightweight, it does not crack, it is easy cut, it is easier and safer to handle, and it is less expensive. Examples of types of walls to which the combination rainscreen/lath assembly can be connected include wood studs, sheathing, and weather resistant barrier ("WRB"); steel studs, sheathing, and WRB; structural insulated panes ("SIP") wall systems; masonry walls with WRB; poured concrete walls with WRB; insulated concrete forms ("ICF") with poured concrete cores and WRB.

Figure 6:
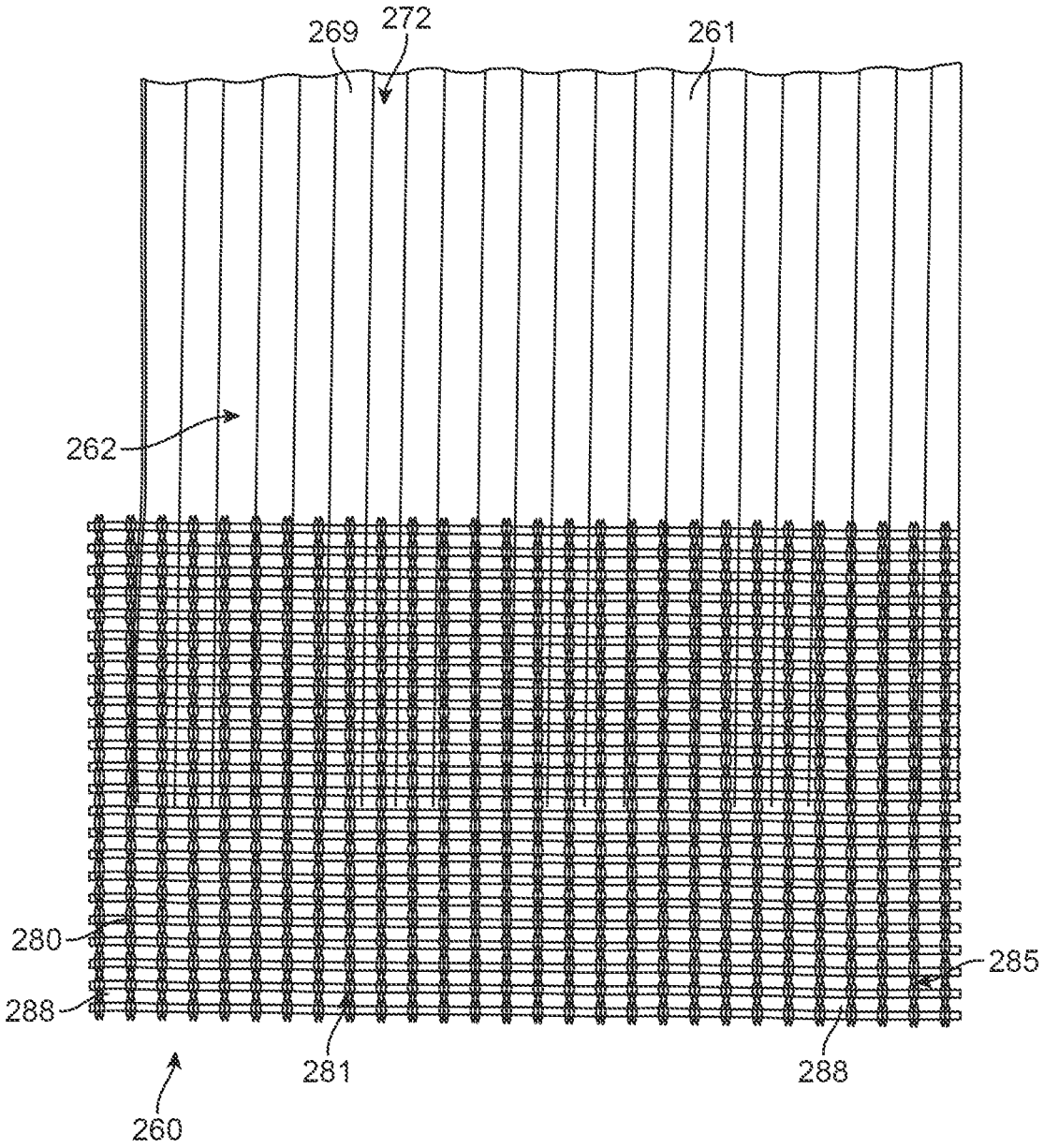
FIG. 6 is a front view of an embodiment combination rainscreen/lath assembly constructed in accordance with the principles of the present invention.

In one embodiment, illustrated in FIG. 6, a combination rainscreen/lath assembly 260 includes a rainscreen layer made of spunbond 261 and a lath layer made of scrim material 280 operatively connected to a front side 262 of the spunbond 261. The spunbond 261 is of similar corrugated construction as spunbond 161 and it is recognized that spunbond 161 or any other suitable material and configuration can be used. An adhesive is applied horizontally onto the spunbond 261 in at least one row so that the outwardly extending portions 269 of the spunbond 261 adhere to the scrim material 280. The scrim material 280 overhangs downward from the spunbond 261 to form a skirt portion 285. The apertures 288 in the scrim material 280 and the outward facing cavities 272 in the spun bond 261 provide voids in which scratch coat can extend when the scratch coat is applied onto the front side 281 of the scrim material 280. The spunbond layer can be 22 inches high and the lath layer can be 24 inches high, and the layers can come in 50 foot long rolls, but it is recognized that any suitable dimensions can be used.

Another example combination lath and rainscreen assembly 1160 is shown in FIGS. 32-35. The assembly 1160 includes a spunbond layer 1161 and a lath layer 1180 that are both crimped or folded to form corrugated layers having grooves or ridges. These layers can be crimped or folded as described for spunbond 161 or 1061 or any other suitable crimping or folding technique. Spunbond layer 1161 has been crimped to form outwardly extending portions 1169 proximate a front side 1162 and inwardly extending portions 1170 proximate a rear side 1163 thereby forming outwardly facing cavities 1172 and inwardly facing cavities 1173. Although spunbond 161, 1061, and 1161 are shown and described, it is recognized that any suitable rainscreen material can be used in any suitable configuration to form corrugated rainscreen. The term "spunbond" used throughout can be substituted with a suitable rainscreen material. It is recognized that crimping or folding the lath layer is optional, and the lath layer crimping or folding can have a different configuration than that of the spunbond layer.

The lath layer 1180 is operatively connected to the spunbond layer 1161 with any suitable attachment means including but not limited to an adhesive, a fastener, or stitching. The crimped or folded lath layer provides a structure to better receive and secure the scratch coat because the space between the lath layer and the spunbond accommodates the scratch coat. Preferably, the spunbond 1161 extends upward from the lath layer 1180 to form a skirt 1165 and the lath layer 1180 extends downward from the spunbond 1161 to form a skirt 1185.

Figure 34:
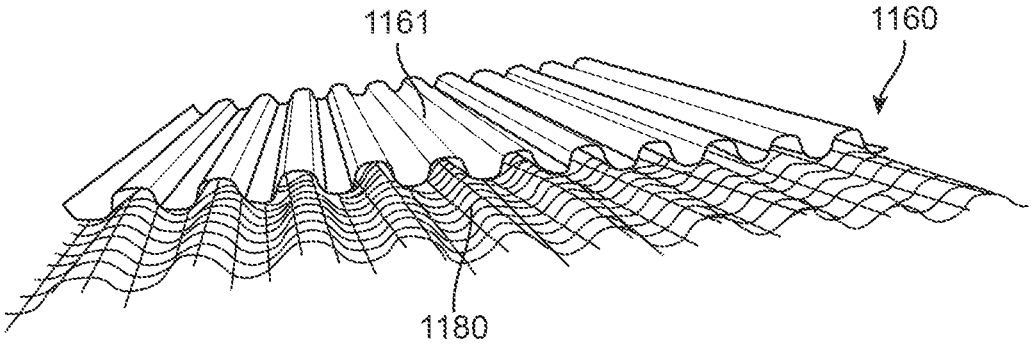
FIG. 34 is a perspective view of the combination rainscreen/lath assembly of FIG. 32.
Figure 35:
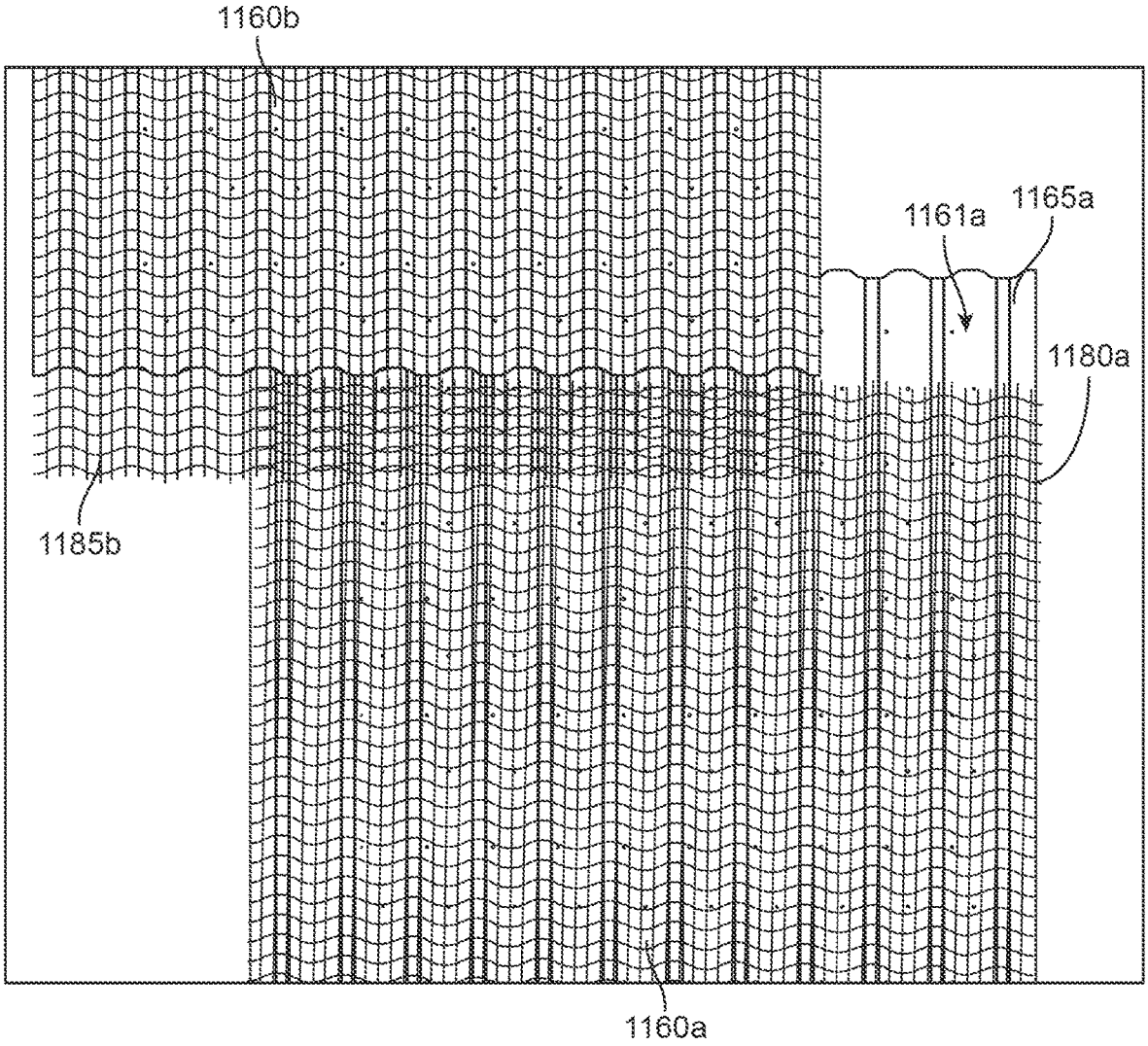
FIG. 35 is a front view of the combination rainscreen/lath assembly of FIG. 32 with another combination rainscreen/lath assembly.

In FIG. 35, it is illustrated how two or more assemblies 1160 can be installed. The first assembly **1160*a* is positioned below the second assembly 1160*b* and, in one embodiment, the assemblies are preferably offset a suitable amount. The spunbond layer of the second assembly 1160*b* is positioned over the skirt 1165*a* of the spunbond layer 1161*a* so that it abuts the lath layer 1180*a* and the skirt 1185*b* extends over a top portion of the lath layer 1180*a*. As shown in FIG. 34**, the crimping patterns of the spunbond and lath layers do not need to correspond and can have different configurations. Preferably, when two or more assemblies are installed, the crimping patterns of the respective layers mate to align drainage channels (for the spunbond layers) or apertures to receive scratch coat (for the lath layers).

Figure 36:
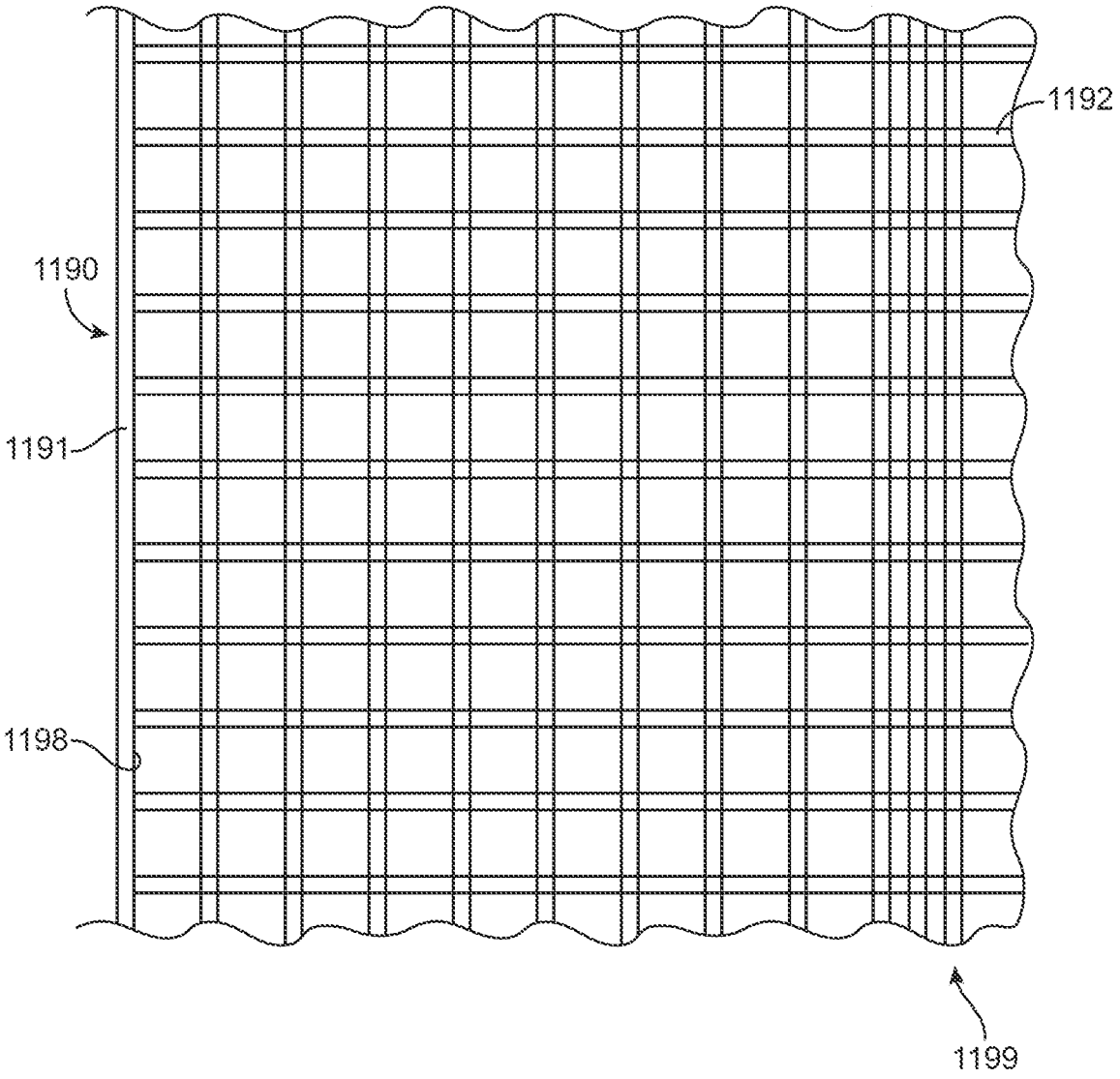
FIG. 36 is a front view of another embodiment lath layer of a combination rainscreen/lath assembly constructed in accordance with the principles of the present invention.

Another example lath layer 1190 is shown in FIG. 36. This lath layer 1190 includes warp strands 1191 and weft strands 1192 interwoven to form apertures 1198 configured and arranged to receive scratch coat. The warp strands 1191 include one or more concentrated portion 1199 that is a group of at least two warp strands spaced closer together than other portions of the lath layer. The one or more concentrated portion 1199 provides additional strength for receiving fasteners to secure the assembly to studs or other structural anchor members. Two or more concentrated portions 1199 can be spaced to correspond with studs or other structural anchor members. The concentrated portion 1199 can also provide an area where the lath layer 1190 is secured to the spunbond layer. In one embodiment, the warp strands 1191 and the weft strands 1192 are approximately ⅛ inch wide and are generally spaced approximately ½ inch from adjacent warp strands 1191 or weft strands 1192 and, in the concentrated portion 1199, the warp strands 1191 are spaced approximately ⅛ inch apart. With three strands of warp strands 1191, the concentrated portion 1199 is approximately ⅝ inch wide. In one embodiment, the lath layer 1190 is 27½ inches wide and 1500 to 2000 feet long. The lath layer 1190 can be coated, preferably with a suitable fire proof material, to add structure to both the lath layer and the assembly. It is recognized that the lath layer 1190 can be used with or without corrugated configurations.

Figure 7A:
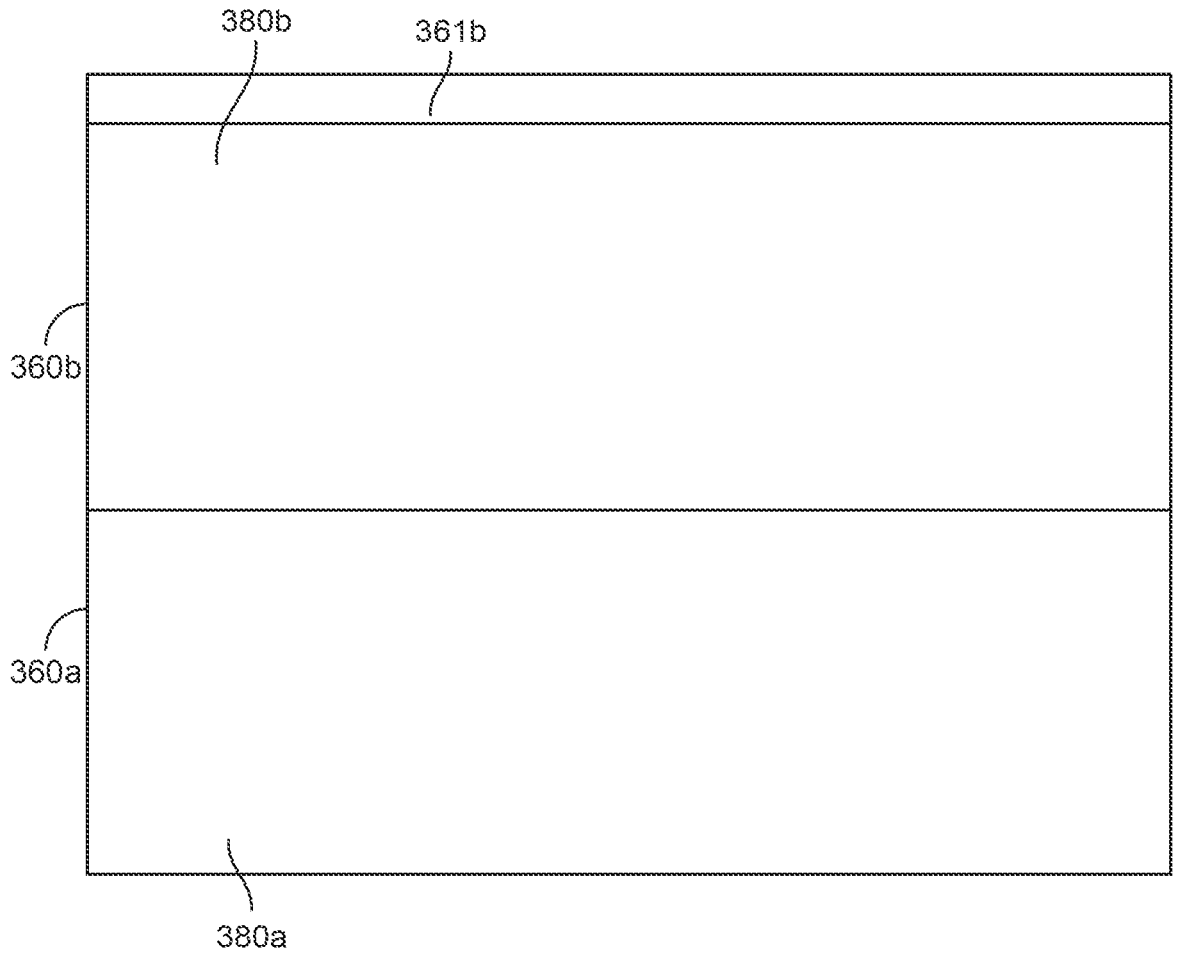
FIG. 7*a* is a front view of an embodiment installation of first and second combination rainscreen/lath assemblies constructed in accordance with the principles of the present invention.
Figure 7B:
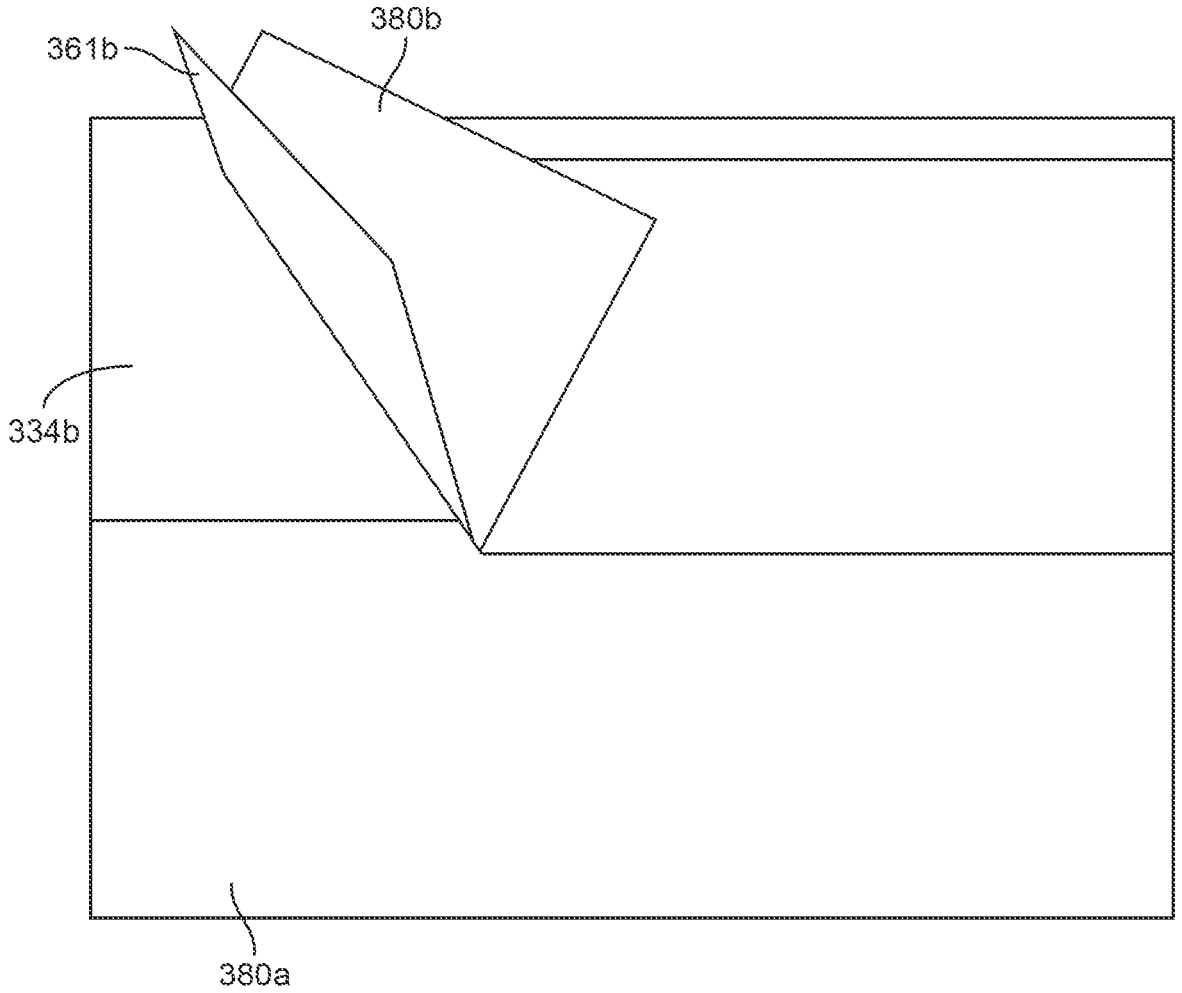
FIG. 7*b* is a front view of the embodiment installation of first and second combination rainscreen/lath assemblies shown in FIG. 7*a* with front and middle layers of the second assembly folded.
Figure 8:
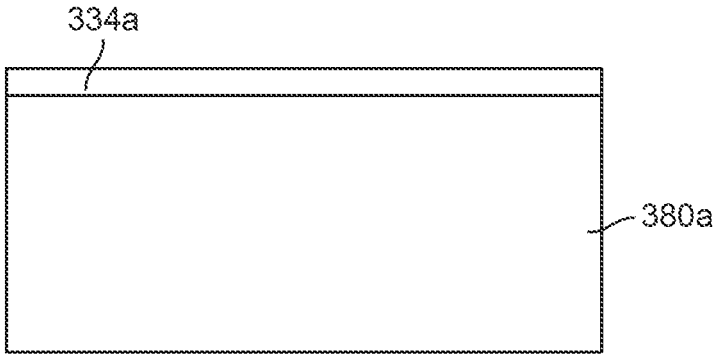
FIG. 8 is a front view of the first assembly shown in FIG. 7*a;*
Figure 9:
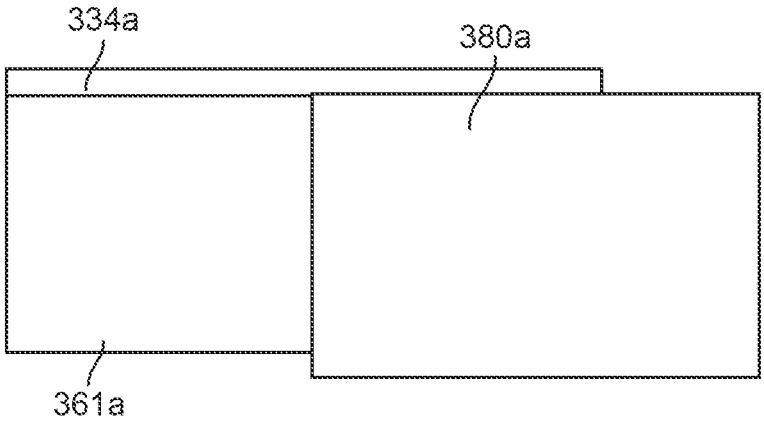
FIG. 9 is a front view of the first assembly shown in FIG. 8 with a front layer folded.
Figure 10:
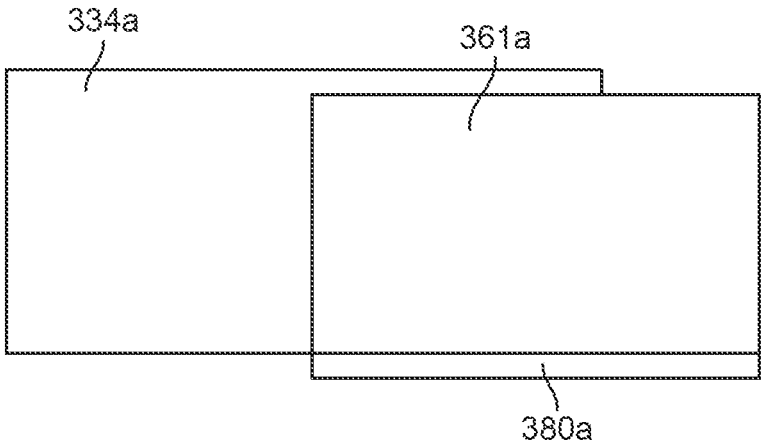
FIG. 10 is a front view of the first assembly shown in FIG. 8 with a front layer and a middle layer folded.
Figure 11:
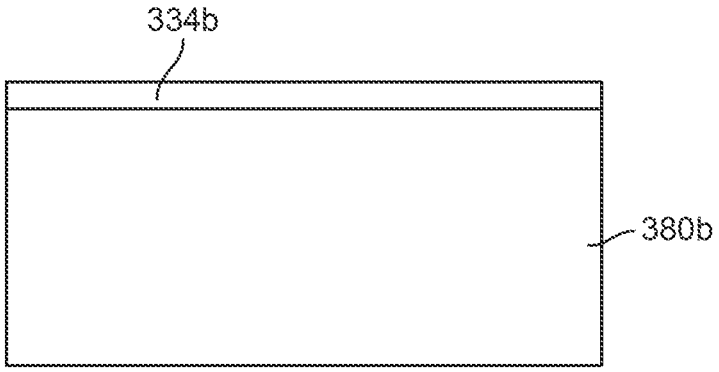
FIG. 11 is a front view of the second assembly shown in FIG. 7*a;*
Figure 12:
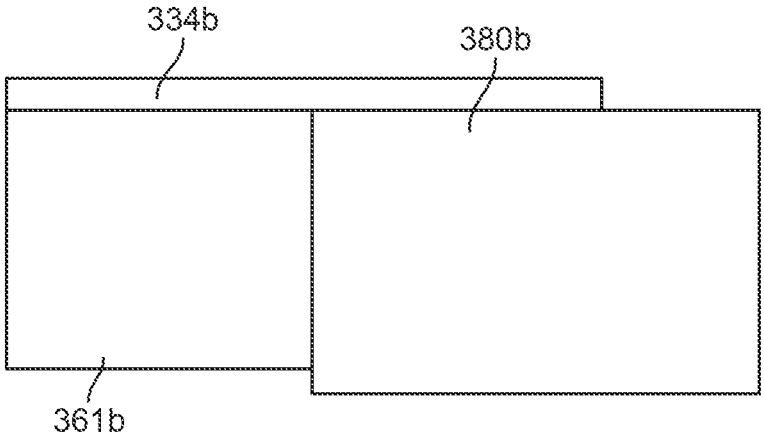
FIG. 12 is a front view of the second assembly shown in FIG. 11 with a front layer folded.
Figure 13:
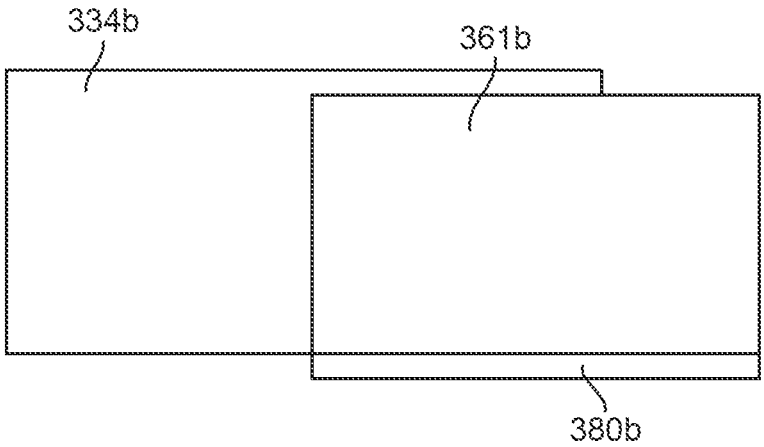
FIG. 13 is a front view of the second assembly shown in FIG. 11 with a front layer and a middle layer folded.

An embodiment method of installation, illustrated in FIGS. 7*a*-13, generally includes overlapping first and second combination rainscreen/lath assemblies 360*a* and 360*b*. In this embodiment, the assemblies 360*a* and 360*b* are the same but it is recognized that they can be different. FIGS. 10 and 13 illustrate optional rear layers 334*a* and 334*b* that are preferably made of high impact polystyrene ("HIPS") that has been crimped at 3/16 inch diameters and are 24 inches in height. FIGS. 9 and 12 illustrate middle layers 361*a* and 361*b* that are preferably made of perforated, lightly crimped (⅛ to ¼ inch pattern), heavy spunbond (0.020 to 0.030 gauge) polypropylene and are 24 inches in height. The middle layers 361*a* and 361*b* are positioned with vertical offsets approximately 2 inches so that skirts of approximately 2 inches of the rear layers 334*a* and 334*b* extend upward from the middle layers 361*a* and 361*b* and skirts of approximately 2 inches of the middle layers 361*a* and 361*b* extend downward from the rear layers 334*a* and 334*b*. FIGS. 8 and 11 illustrate front layers 380*a* and 380*b* that are preferably made of heavy scrim material (0.025 to 0.035 gauge) and are 26 inches in height. The tops of the front layers 380*a* and 380*b* align with the tops of the middle layers 361*a* and 361*b* and skirts of approximately 2 inches extend downward from the middle layers 361*a* and 361*b*. When installed, as shown in FIGS. 7*a* and 7*b*, the assembly 360*a* is first secured to the studs using suitable fasteners such as nails or staples. Then, the bottom of the rear layer 334*b* is positioned on top of the rear layer 334*a* skirt to abut the tops of the middle layer 361*a* and the front layer 380*a* so that approximately 2 inches of the middle layer 361*b* and approximately 4 inches of the front layer 380*b* extend downward over the front layer 380*a*. Although two assemblies are shown, it is recognized that any suitable number of assemblies can be installed in such overlapping fashion. It is recognized that any suitable dimensions can be used. The corrugated spunbond layer creates spaces between the corrugated spunbond layer and adjacent materials.

Figure 14A:
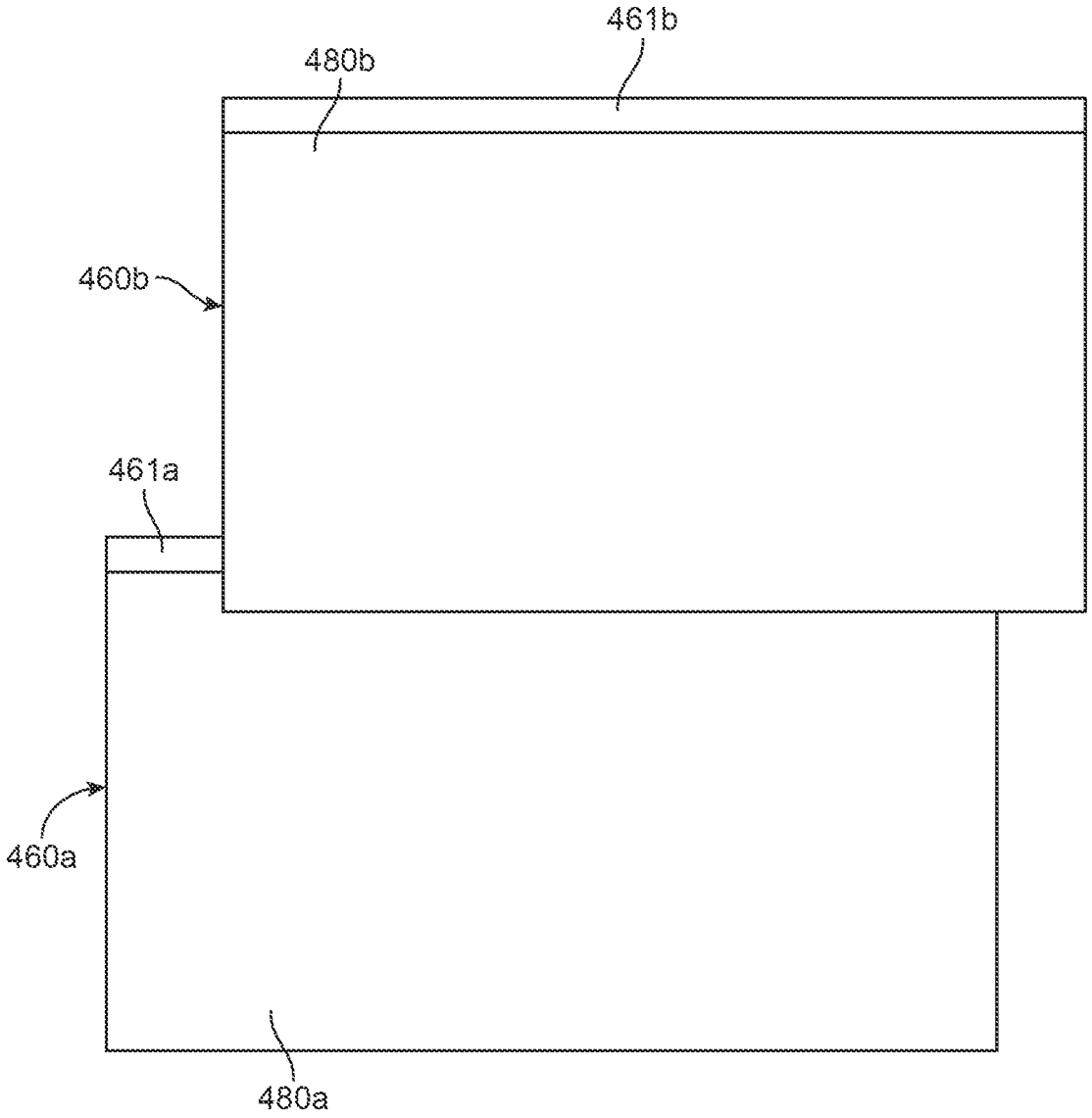
FIG. 14*a* is a front view of another embodiment installation of first and second combination rainscreen/lath assemblies constructed in accordance with the principles of the present invention.
Figure 14B:
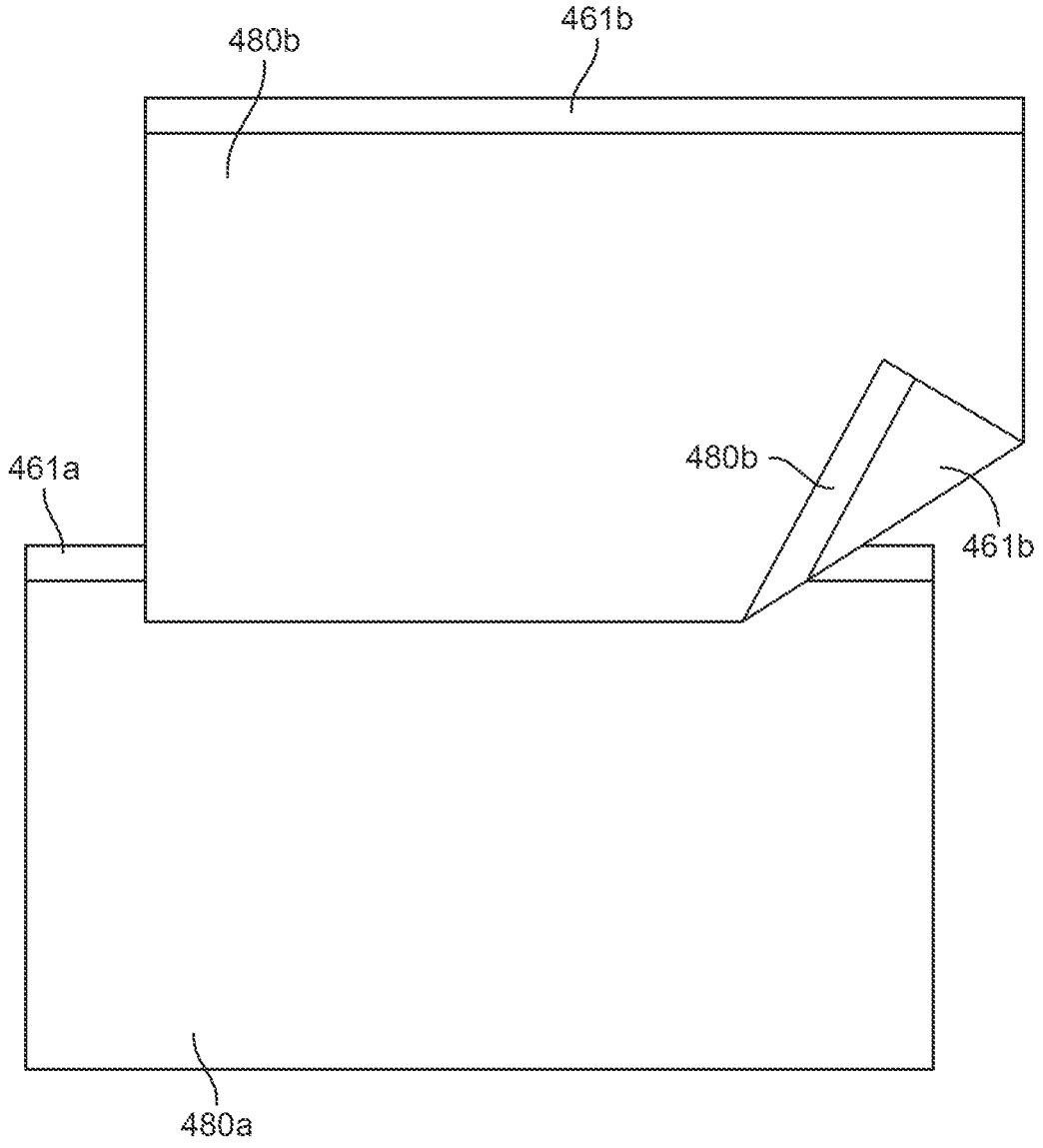
FIG. 14*b* is a front view of the embodiment installation of first and second combination rainscreen/lath assemblies shown in FIG. 14*a* with a front layer of the second assembly folded.
Figure 14C:
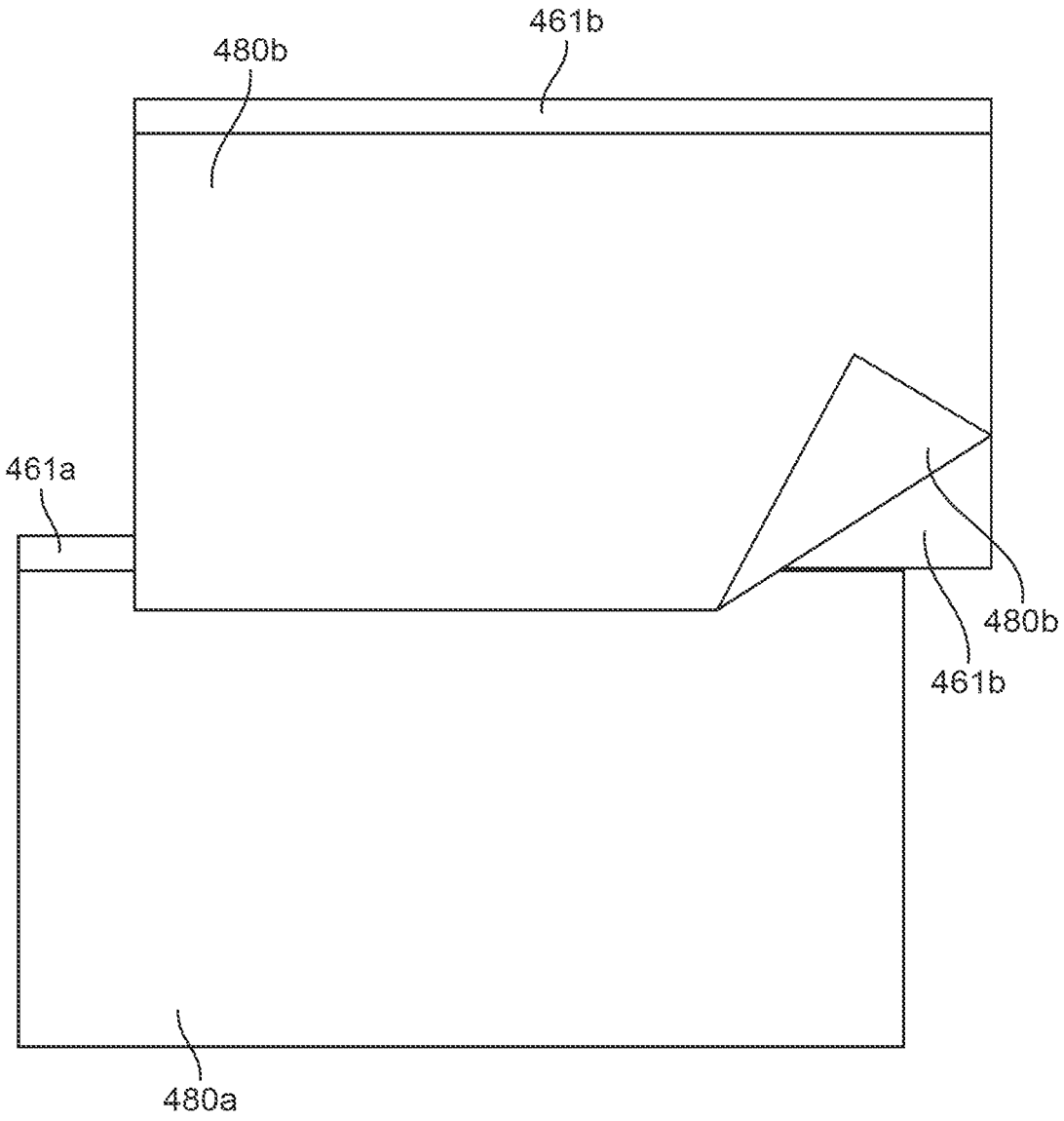
FIG. 14*c* is a front view of the embodiment installation of first and second combination rainscreen/lath assemblies shown in FIG. 14*a* with a front layer and a rear layer of the second assembly folded.
Figure 15:
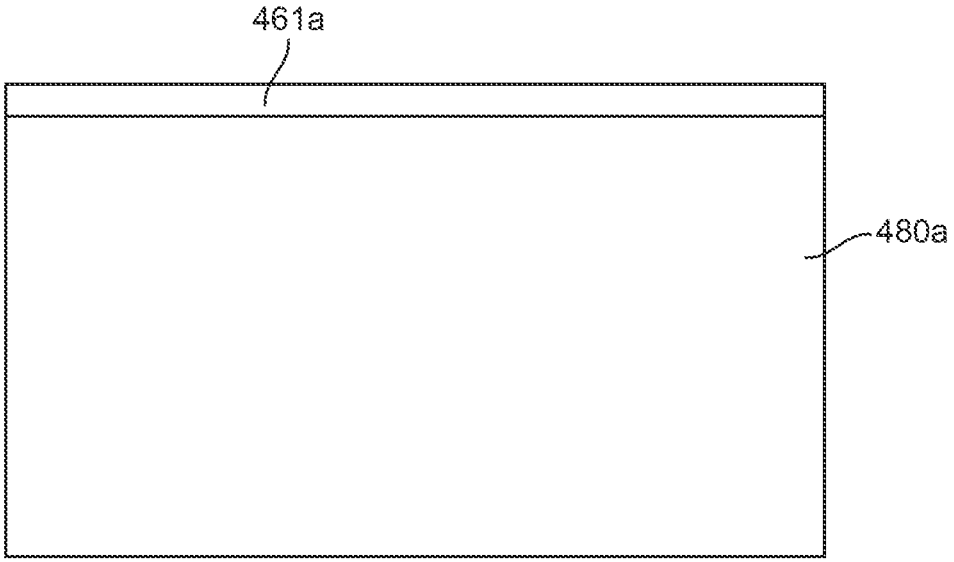
FIG. 15 is a front view of the first assembly shown in FIG. 14*a;*
Figure 16:
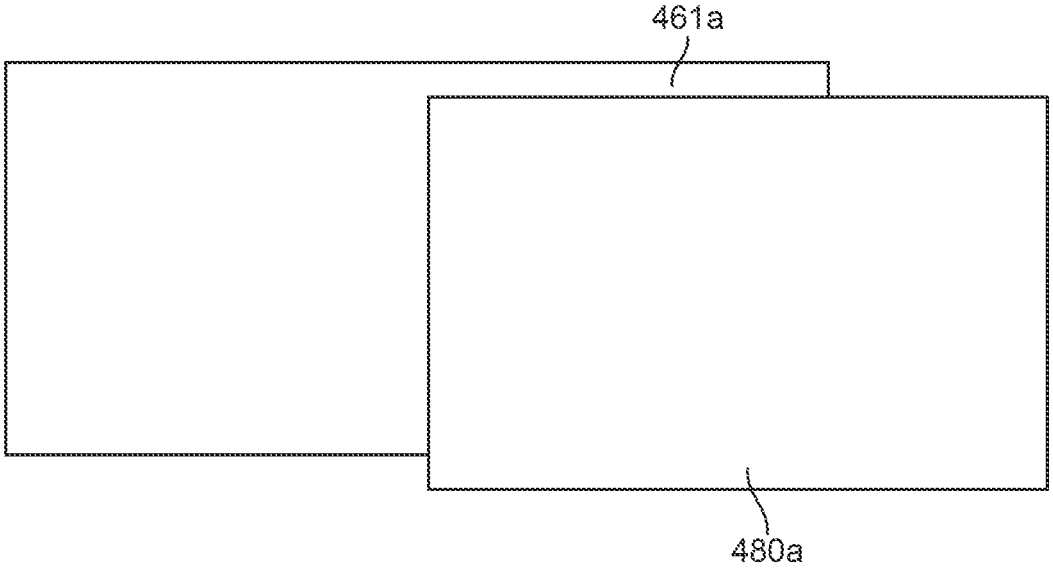
FIG. 16 is a front view of the first assembly shown in FIG. 15 with a front layer folded.
Figure 17:
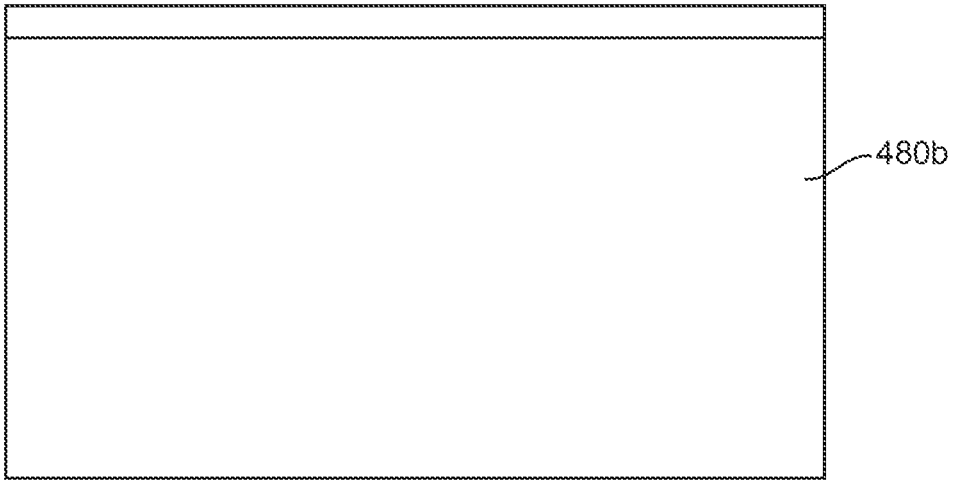
FIG. 17 is a front view of the second assembly shown in FIG. 14*a;*
Figure 18:
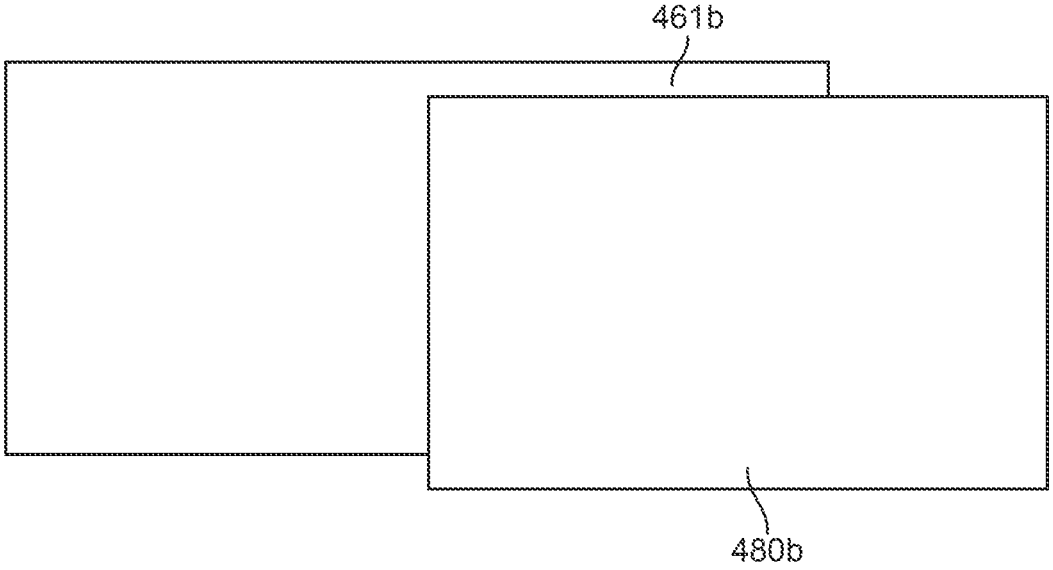
FIG. 18 is a front view of the second assembly shown in FIG. 15 with a front layer folded.
Figure 19:
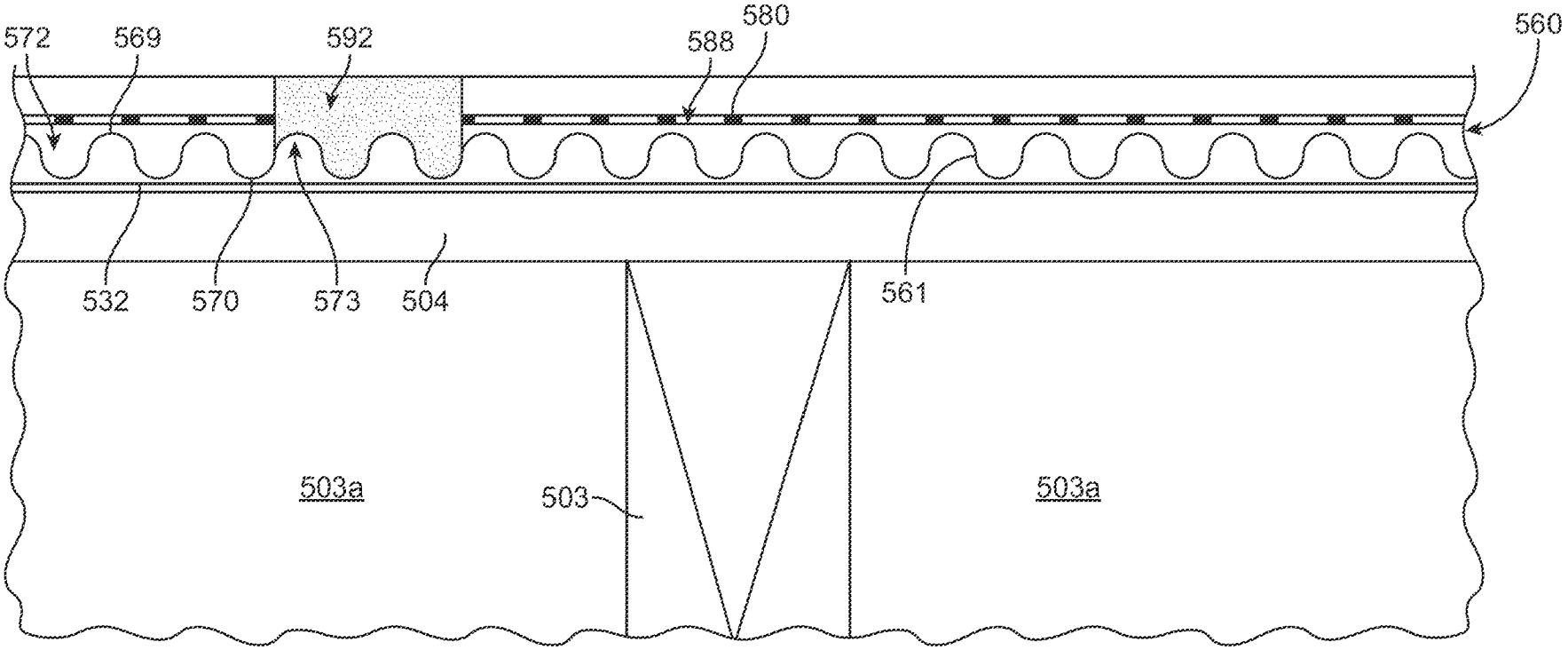
FIG. 19 is a side view of another embodiment installation of a combination rainscreen/lath assembly connected to a wall.

An embodiment method of installation, illustrated in FIGS. 14*a*-18, generally includes overlapping first and second combination rainscreen/lath assemblies 460*a* and 460*b*. In this embodiment, the assemblies 460*a* and 460*b* are the same but it is recognized that they can be different. FIGS. 16 and 18 illustrate rear layers 461*a* and 461*b* that are preferably made of crimped spunbond polypropylene and are preferably 24 inches in height, 50 feet in length (rolls). FIGS. 15 and 17 illustrate front layers 480*a* and 480*b* that are preferably made of scrim material and are 24 inches in height, 50 feet in length (rolls). The front layers 480*a* and 480*b* are positioned with vertical offsets approximately 2 inches relative to the rear layers 461*a* and 461*b* so that skirts of approximately 2 inches of the rear layers 461*a* and 461*b* extend upward from the front layers 480*a* and 480*b* and skirts of approximately 2 inches of the front layers 480*a* and 480*b* extend downward from the rear layers 461*a* and 461*b*. When installed, as shown in FIGS. 14*a*, 14*b*, and 14*c*, the assembly 460*a* is first secured to the studs using suitable fasteners such as nails or staples. Then, the bottom of the rear layer 461*b* is positioned on top of the rear layer 461*a* skirt to abut the top of the front layer 480*a* so that approximately 2 inches of the front layer 480*b* extends downward over the front layer 480*a*. To stagger the seams, the assembly 480*b* can be horizontally offset relative to the assembly 480*a*, as shown. Although two assemblies are shown, it is recognized that any suitable number of assemblies can be installed in such overlapping fashion. It is recognized that any suitable dimensions can be used. The corrugated spunbond layer creates spaces between the corrugated spunbond layer and adjacent materials.

Figure 20:
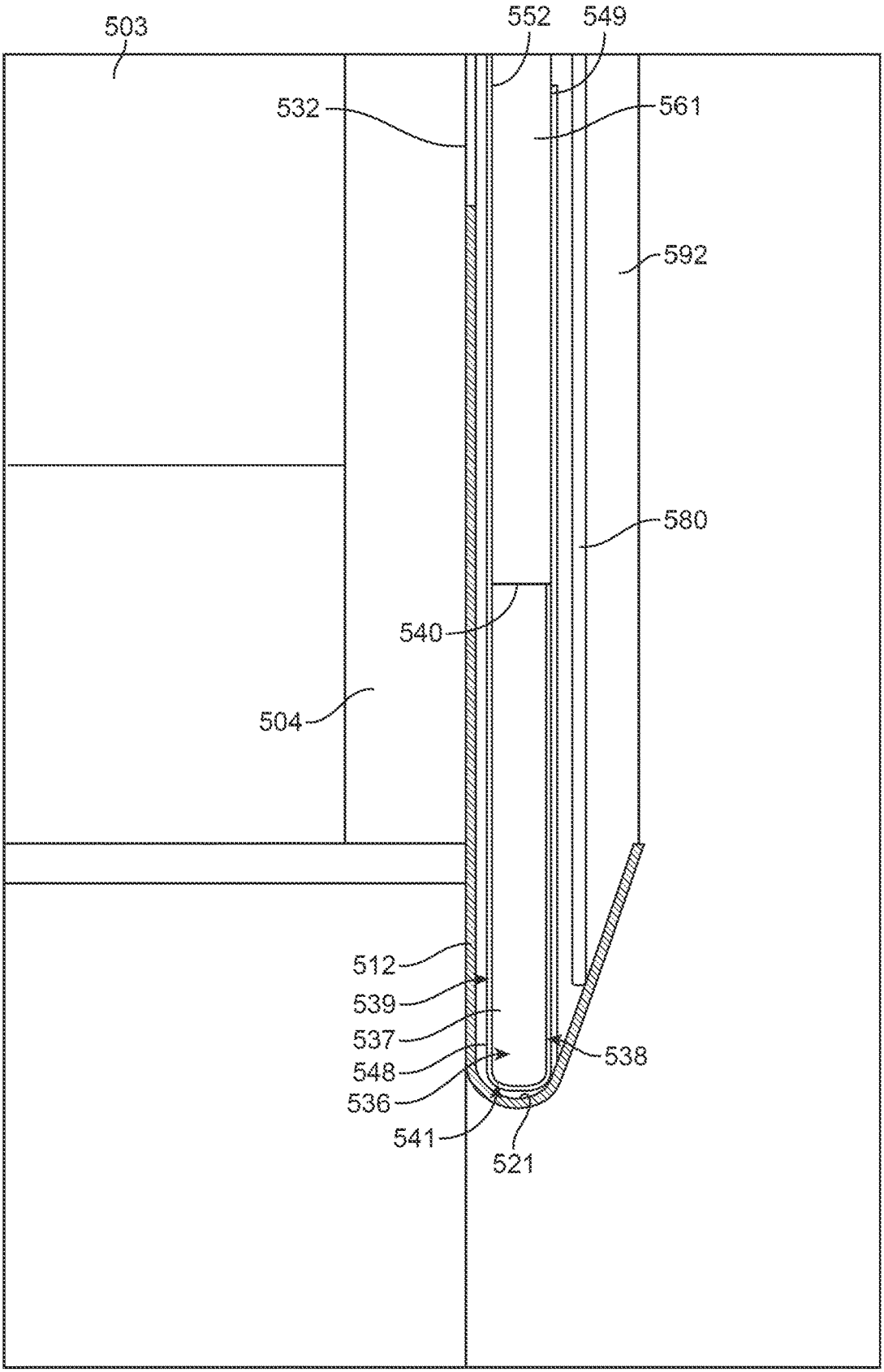
FIG. 20 is a side view of another embodiment installation of the combination rainscreen/lath assembly shown in FIG. 19 connected to a wall with a weep screed.

An embodiment method of installation, illustrated in FIGS. 19-22, generally includes sheathing 504 connected to studs 503, which could be wood or steel studs, and water resistant barrier 532 connected to the sheathing 504, as is known in the art. The studs 503 are spaced apart to create stud cavities 503*a* therebetween. As shown in FIG. 20, a weep screed 512 is connected to the sheathing 504 proximate the foundation so that a bottom portion of the weep screed 512 overhangs a top portion of the foundation. The water resistant barrier 532 is positioned over approximately 2 inches of the top portion of the weep screed 512. A starter strip 536 including spunbond 548 positioned about a front 538, a bottom 541, and a rear 539 of a base 537 is positioned within a cavity 521 of the weep screed 512 with front and rear flanges 549 and 552 of the spunbond 548 extending upward approximately 4 inches. The base 537 is made of corrugated HIPS at 3/16 inch by 2 inches. Although dimensions are listed for embodiments, it is recognized that any suitable dimensions can be used.

Figure 21:
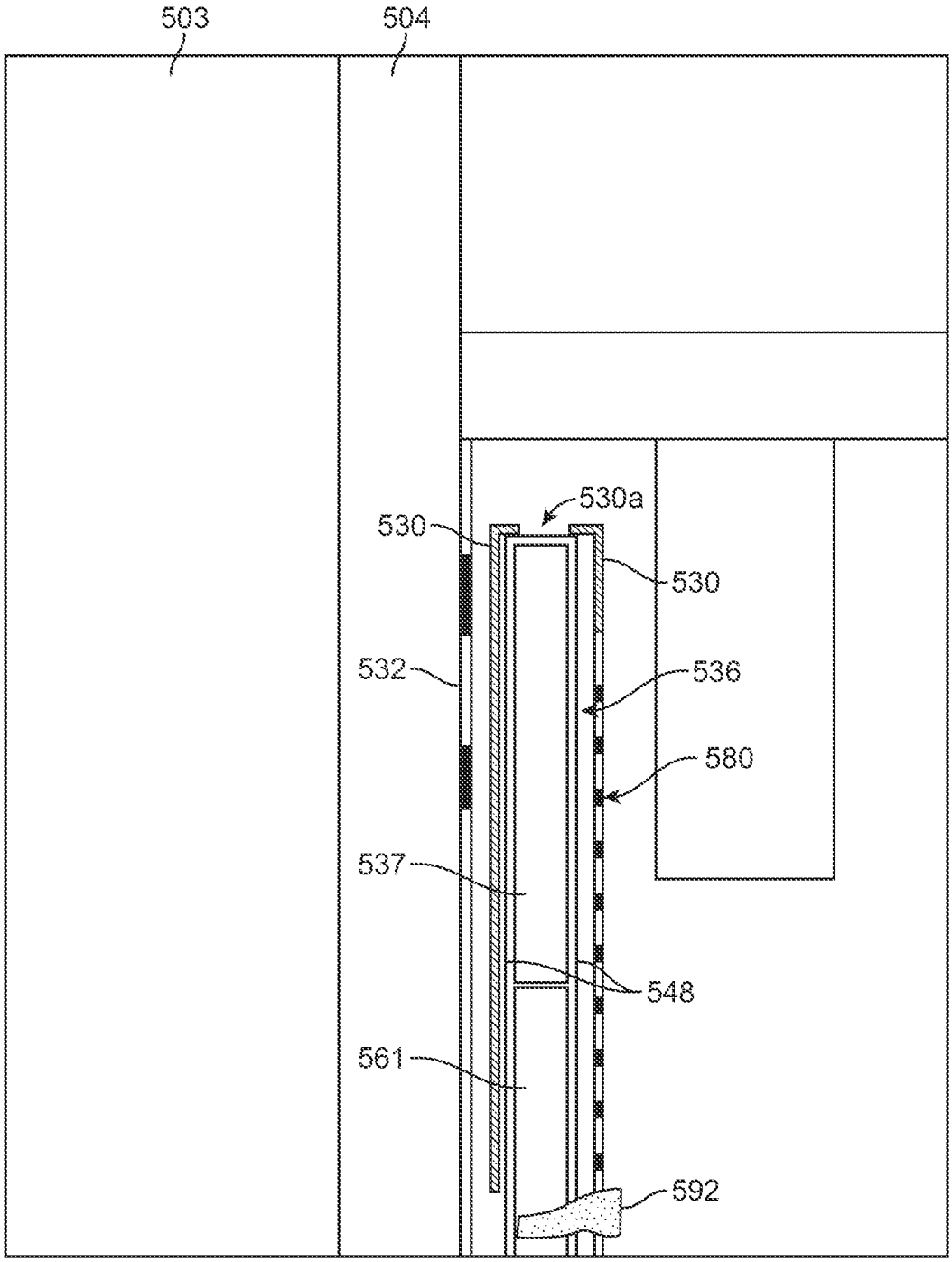
FIG. 21 is a side view of another embodiment installation of the combination rainscreen/lath assembly shown in FIG. 19 connected to a wall with a vented edge metal.
Figure 22:
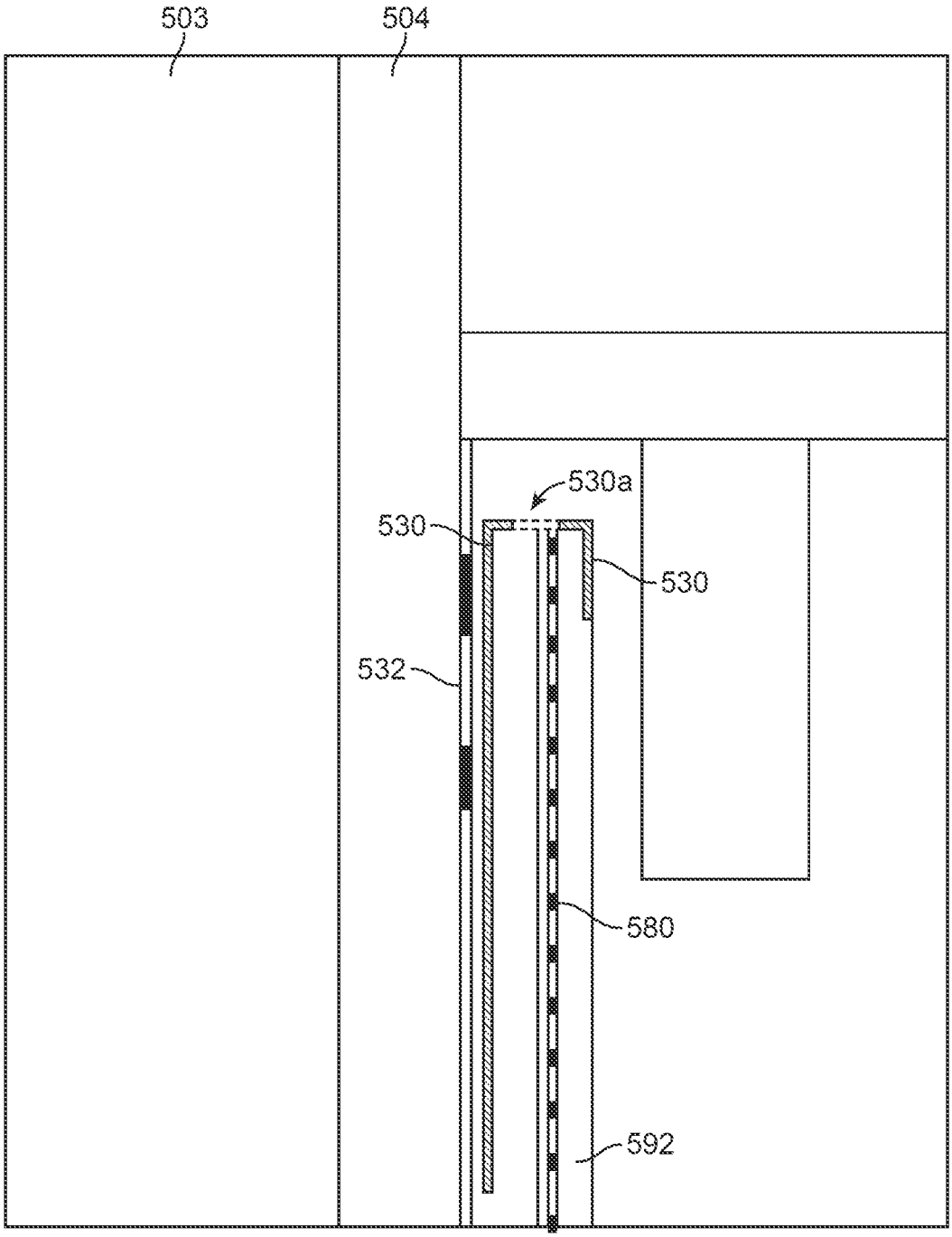
FIG. 22 is a side view of another embodiment installation of the combination rainscreen/lath assembly shown in FIG. 19 connected to a wall with another vented edge metal.

The combination rainscreen/lath assembly 560 is positioned with the spunbond 561 facing rearward proximate the water resistant barrier 532 and the lath 580 facing frontward. The spunbond 561 is made of polypropylene and is perforated and corrugated to 5/16 inch diameters. The lath 580 is scrim material including apertures 588. The spunbond 561 creates inward facing cavities 573 between the inwardly extending portions 570 and creates outward facing cavities 572 between the outwardly extending portions 569. The first row of the assembly 560 is positioned with the bottom of the spunbond 561 abutting a top 540 of the starter strip base 537 between the rear and front flanges 549 and 552. The bottom of the lath 580 is positioned over the front flange 549, and the lath 580 is configured and arranged to receive a scratch coat 592. At the top, as illustrated in FIGS. 21 and 22, vented edge material 530 with apertures 530*a* can be used with (FIG. 21) or without (FIG. 22) a starter strip 536, as known in the art.

Figure 23:
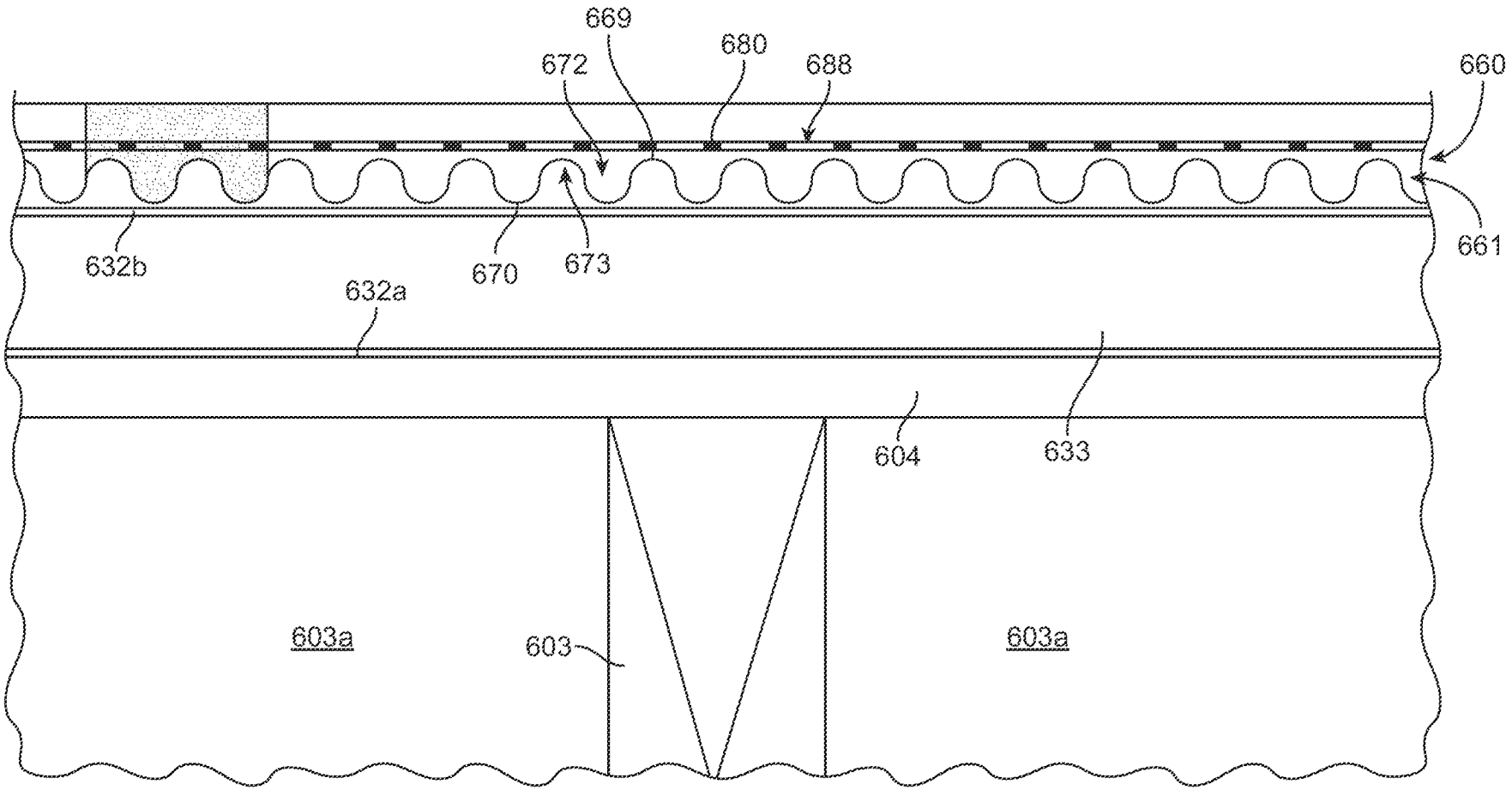
FIG. 23 is a side view of another embodiment installation of a combination rainscreen/lath assembly connected to a wall.

An embodiment method of installation, shown in FIG. 23, generally includes sheathing 604 connected to studs 603, which could be wood or steel studs, and water resistant barrier 632*a* can be connected between the sheathing 604 and rigid insulation 633 or water resistant barrier 632*b* can be connected to the rigid insulation, as is known in the art. The studs 603 are spaced apart to create stud cavities 603*a* therebetween. The combination rainscreen/lath assembly 660 is positioned with the spunbond 661 facing rearward proximate the rigid insulation 633 or the water resistant barrier 632*b* and the lath 680 facing frontward. The spunbond 661 is made of polypropylene and is perforated and corrugated to 5/16 inch diameters. The lath 680 is scrim material including apertures 688. The spunbond 661 creates inward facing cavities 673 between the inwardly extending portions 670 and creates outward facing cavities 672 between the outwardly extending portions 669. The assembly 660 can be installed in a similar manner as the assembly 560 using a weep screed and edging.

As illustrated in FIGS. 24-30, another embodiment method of installation includes attaching a suitable weep screed (not shown) and optional deflector (not shown) along a bottom of a wall at a code approved elevation from an existing exterior grade and attaching suitable window and door flashing (not shown), as known in the art. A weather resistant barrier ("WRB") 832 applied to the wall has a bottom that is positioned to overlap a back flange of the weep screed without interrupting vent slots in the weep screed. The weep screed accommodates air flow and drainage capacity, and an example of a suitable weep screed is L&R Weep Screed, LR 3501, by Masonry Technology, Inc. Optionally, a weep screed deflector, such as WSD 1309 by Masonry Technology, Inc., can be used with the weep screed. A bug screen can also be used as is known in the art. Openings for windows, doors, etc. preferably terminate with edging, and an example of suitable edging is MTI Edge Metal, MEM 3168, by Masonry Technology, Inc.

Figure 24:
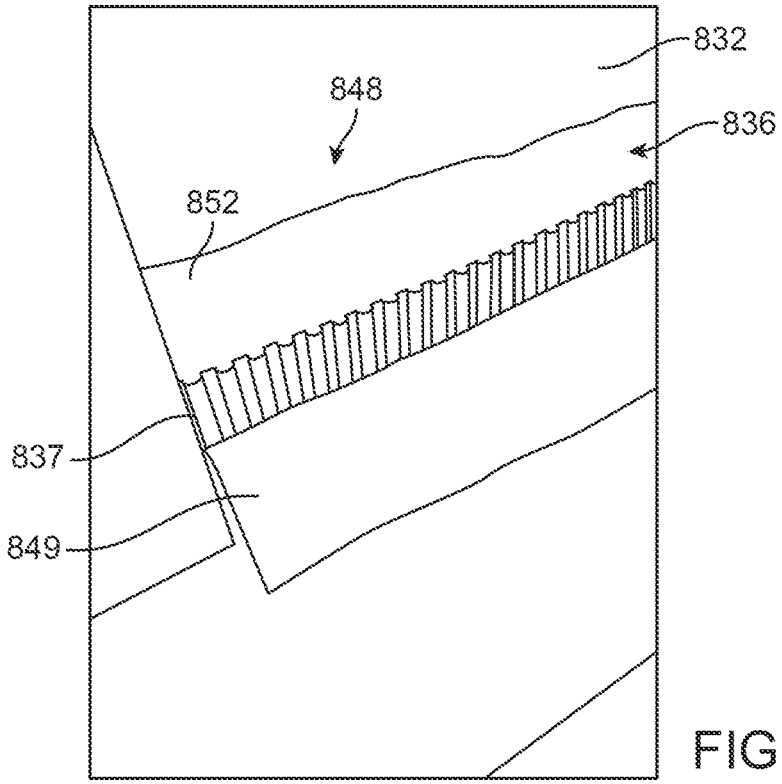
FIG. 24 is a front view of another embodiment installation showing a step of installing a starter strip.
Figure 25:
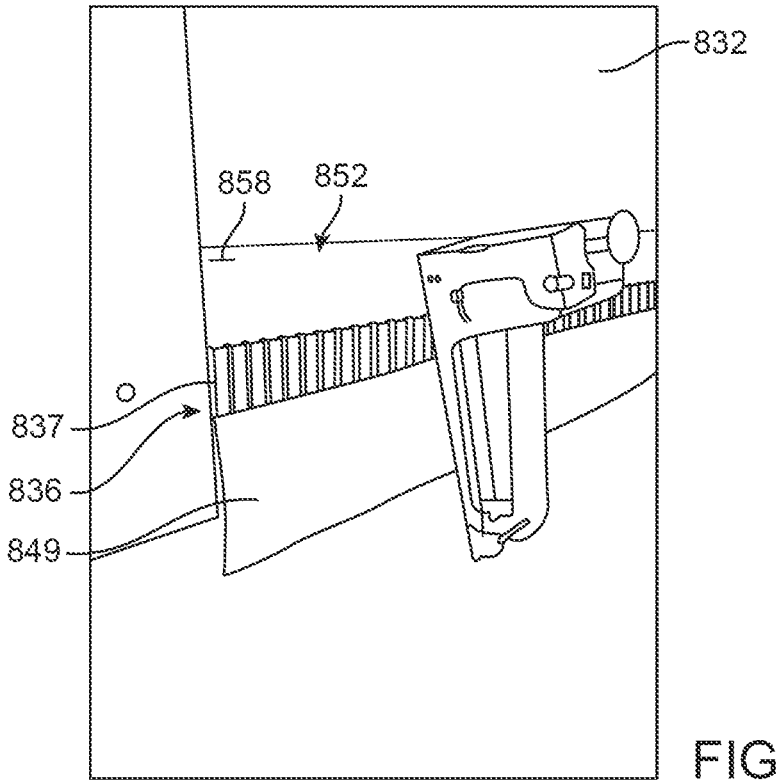
FIG. 25 is a front view of the embodiment installation of FIG. 24 showing a step of fastening the starter strip to a wall.
Figure 26:
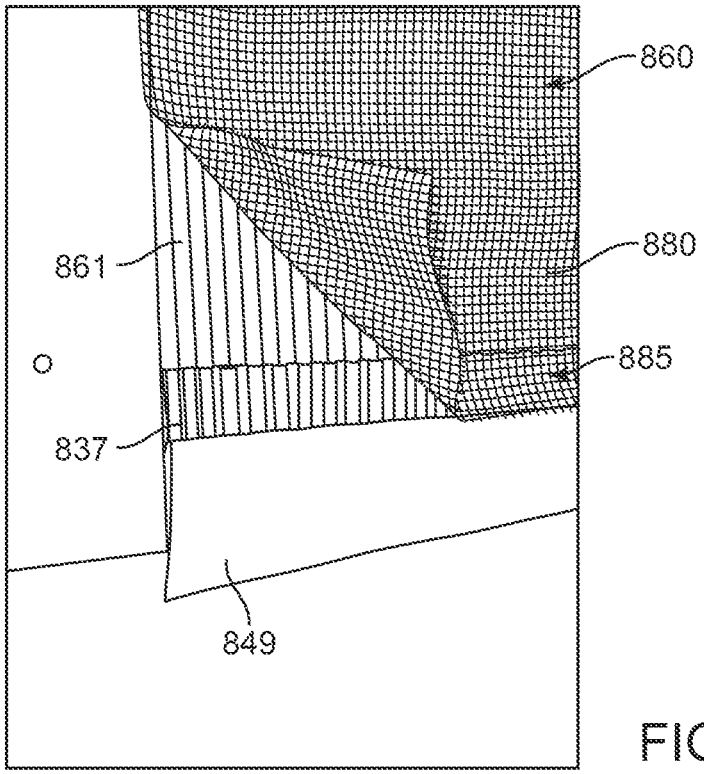
FIG. 26 is a front view of the embodiment installation of FIG. 24 showing a step of installing a first combination rainscreen/lath assembly to the wall.
Figure 27:
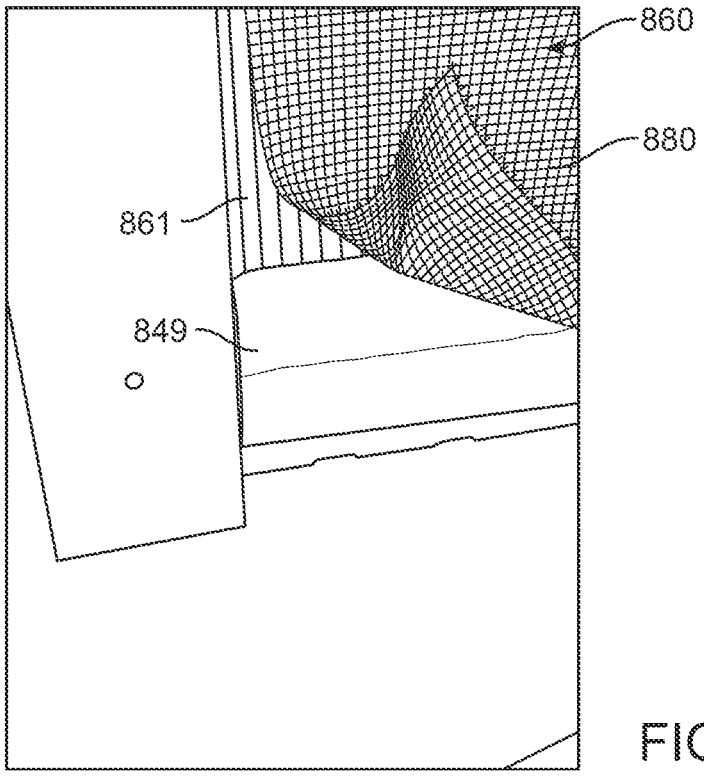
FIG. 27 is a front view of the embodiment installation of FIG. 24 showing a step of positioning the first combination rainscreen/lath assembly relative to the starter strip.
Figure 28:
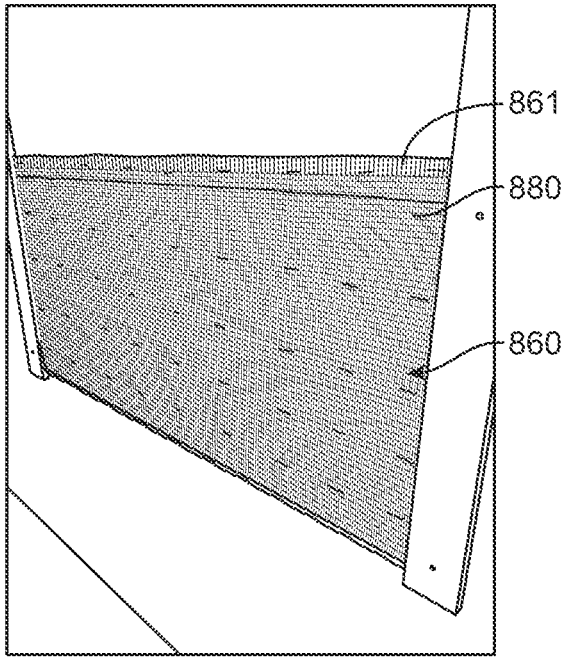
FIG. 28 is a front view of the embodiment installation of FIG. 24 showing a step of installing the first combination rainscreen/lath assembly to the wall.

As shown in FIGS. 24 and 25, a starter strip 836, for example Corrugated Lath Starter Strip, CLSS 2316, by Masonry Technology, Inc., is installed so that the bottom edge of the starter strip's base 837 is seated into the cavity of the weep screed (not shown) to ensure that no scratch coat mortar reaches the weep screed's vent slots when it is applied. An example of a suitable base is 2 inches high corrugated high impact polystyrene. The starter strip's spunbond 848 is wrapped about the base 837 so that a rear flange 852 and a front flange 849 extend upward from the base's bottom. The rear flange 852 is secured to the rear side of the base, and the rear flange 852 is secured to the wall, for example using fasteners 858 such as nails or staples, preferably at each stud (not shown). A combination rainscreen/lath assembly includes corrugated spunbond and lath offset vertically about 2 inches so that about 2 inches of spunbond extend upward from the lath and about 2 inches of lath extend downward from the spunbond. A first course of combination rainscreen/lath assembly 860 is installed horizontally with a bottom edge of corrugated spunbond 861 abutting a top edge of the base 837. Fasteners such as nails or stapes are inserted through the assembly 860 into the wall, preferably at each stud, in accordance with code requirements. The front flange 849 is positioned over the base 837 and the spunbond 861, and the skirt 885 of the lath 880 is positioned over the spunbond 861, as shown in FIGS. 26-28.

Figure 29:
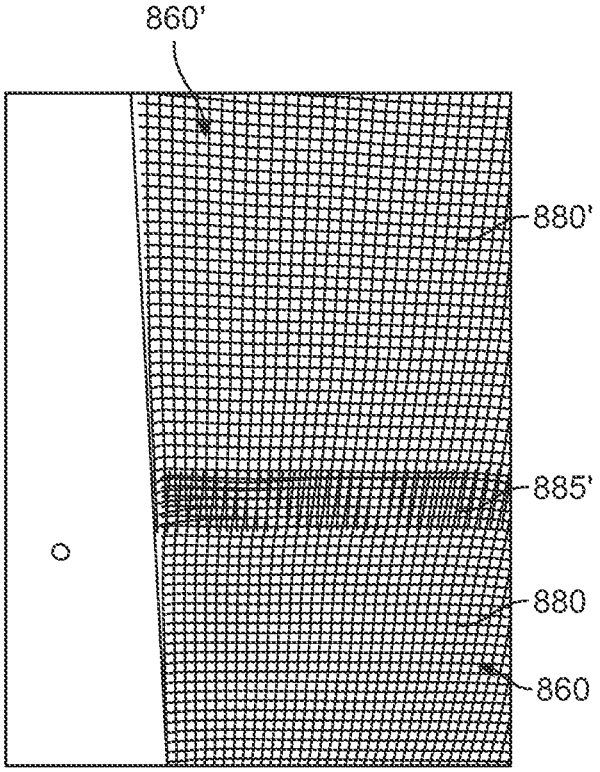
FIG. 29 is a front view of the embodiment installation of FIG. 24 showing a step of installing a second combination rainscreen/lath assembly to the wall.

A second course of combination rainscreen/lath assembly 860' is installed horizontally with a bottom portion of the second corrugated spunbond (not shown) overlapping a top portion of the first corrugated spunbond 861 and the skirt 885' of the second lath 880' is positioned over the first lath 880, as shown in FIG. 29. Fasteners such as nails or stapes are inserted through the assembly 860' into the wall, preferably at each stud, in accordance with code requirements.

Figure 30:
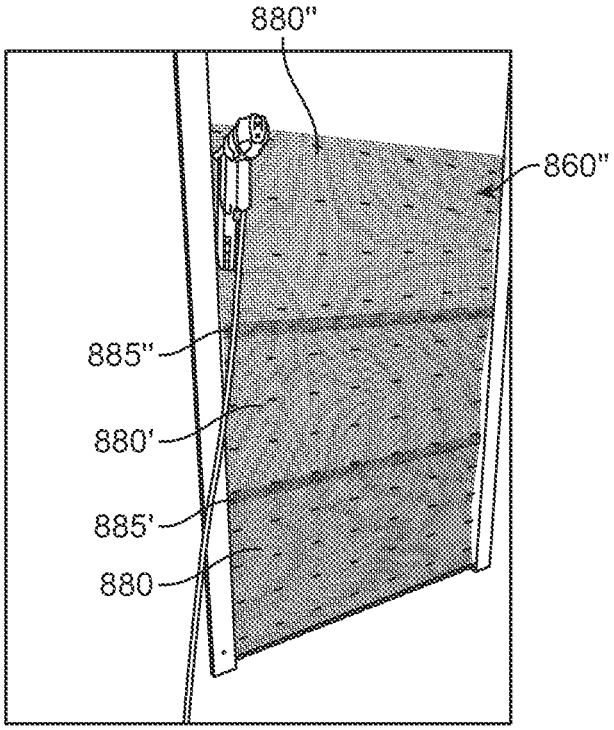
FIG. 30 is a front view of the embodiment installation of FIG. 24 showing a step of installing a third combination rainscreen/lath assembly to the wall.

A third course of combination rainscreen/lath assembly 860" is installed horizontally with a bottom portion of the third corrugated spunbond (not shown) overlapping a top portion of the second corrugated spunbond (not shown) and the skirt 885" of the third lath 880" is positioned over the second lath 880', as shown in FIG. 30. Fasteners such as nails or stapes are inserted through the assembly 860" into the wall, preferably at each stud, in accordance with code requirements.

Although not shown in this embodiment, the top of the final course of combination rainscreen/lath assembly preferably terminates with a vented metal edge with venting capacity, for example Vented MTI Edge Metal, VMEM 3168, by Masonry Technology, Inc. The top of the vented metal edge is preferably installed approximately ⅜ inch down from the bottom of the soffit, and a starter strip is positioned with its "bottom" edge seated into the vented metal edge cavity to ensure no scratch coat goes into the vent slots. The top edge of the combination rainscreen/lath assembly's corrugated spunbond preferably contacts the bottom edge of the starter strip's base, with the starter strip's rear and front flanges of spunbond extending downward and overlapping the top portion of the assembly's spunbond on opposing sides, and the assembly's lath extending upward and overlapping the front flange of spunbond.

The lath is configured and arranged to receive scratch coat within its apertures, and the corrugated spunbond provides areas for scratch coat extending through the apertures proximate the opposing side of the lath to which the scratch coat was applied. If the corrugated spunbond includes perforations or apertures, the scratch coat can also extend through at least some of these apertures for additional adherence and support. Preferably the spunbond's apertures are large enough to incorporate some of the scratch coat but not large enough for the scratch coat to extend through the spunbond and block the spunbond's channels. The corrugated spun bond also provides a drainage plane, which also provides a gap or thermo-break resulting in an insulation R-value for energy efficiency. The spunbond's channels, which form the drainage plane, allow for venting of air and moisture thereby assisting in reducing any accumulation of moisture. Moisture can move through the scratch coat to drain through the channels and out of the voids. Because there are voids or venting in the bottom and the top, there is a "chimney effect" to assist in venting.

Although specific embodiments have been illustrated and described herein, it will be appreciated by those of ordinary skill in the art that a variety of alternate and/or equivalent implementations can be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A method of installing a first combination rainscreen and lath assembly and a second combination rainscreen and lath assembly onto a wall, comprising:

providing the first combination rainscreen and lath assembly and the second combination rainscreen and lath assembly;

positioning the first combination rainscreen and lath assembly on the wall with a first corrugated spunbond layer facing toward the wall, a first lath layer facing away from the wall, and a first skirt portion of the first lath layer extending downward beyond the first corrugated spunbond layer, the first corrugated spunbond layer and the first lath layer being installed simultaneously as part of the first combination rainscreen and lath assembly;

aligning a bottom of the first corrugated spunbond layer with a top of a starter strip base, positioning a starter strip spunbond layer over the first corrugated sp layer, and positioning the first lath layer over starter strip spunbound layer, wherein the starter strip spunbond layer includes a rear flange and a front flange, and positioning the rear flange proximate a rear side of the first corrugated spunbound layer and positioning the front flange proximate a front side of the first corrugated layer;

fastening the first combination rainscreen and lath assembly to the wall;

positioning the second combination rainscreen and lath assembly on the wall above the first combination rainscreen and lath assembly with a second corrugated spunbond layer facing toward the wall, a second lath layer facing away from the wall, and a second skirt portion of the second lath layer extending downward beyond the second corrugated spunbond layer, the second corrugated spunbond layer and the second lath layer being installed simultaneously as part of the second combination rainscreen and lath assembly;

aligning a bottom of the second corrugated spunbond layer with a top of the first corrugated spunbond layer;

overlapping the second skirt portion on the first lath layer; and fastening the second combination rainscreen and lath assembly to the wall.

2. The method of claim 1, further comprising overlapping a bottom portion of the second corrugated spunbond layer on a top portion of the first corrugated spunbond layer.

3. The method of claim 1, wherein the second combination rainscreen and lath assembly is horizontally offset from the first combination rainscreen and lath assembly so side edges of the first combination rainscreen and the second combination rainscreen are not aligned.

4. The method of claim 1, wherein at least one of the first combination rainscreen and lath assembly and the second combination rainscreen and lath assembly includes a corrugated spunbond layer that is at least partially perforated.

5. The method of claim 1, wherein at least one of the first combination rainscreen and lath assembly and the second combination rainscreen and lath assembly includes a corrugated lath layer.

6. A method of installing a first combination rainscreen and lath assembly and a second combination rainscreen and lath assembly onto a wall, comprising:

providing the first combination rainscreen and lath assembly and the second combination rainscreen and lath assembly;

positioning the first combination rainscreen and lath assembly on the wall with a first corrugated spunbond layer facing toward the wall, a first lath layer facing away from the wall, and a first skirt portion of the first lath layer extending downward beyond the first corrugated spunbond layer;

aligning a bottom of the first corrugated spunbond layer with a top of a starter strip base, positioning a starter strip spunbond layer over the first corrugated spunbond layer, and positioning the first lath layer over the starter strip spunbond layer, wherein the starter strip spunbond layer includes a rear flange and a front flange, and positioning the rear flange proximate a rear side of the first corrugated spunbond layer and positioning the front flange proximate a front side of the first corrugated spunbond layer;

fastening the first combination rainscreen and lath assembly to the wall;

positioning the second combination rainscreen and lath assembly on the wall above the first combination rainscreen and lath assembly with a second corrugated spunbond layer facing toward the wall, a second lath layer facing away from the wall, and a second skirt portion of the second lath layer extending downward beyond the second corrugated spunbond layer;

aligning a bottom of the second corrugated spunbond layer with a top of the first corrugated spunbond layer;

overlapping the second skirt portion on the first lath layer; and fastening the second combination rainscreen and lath assembly to the wall.

7. The method of claim 6, further comprising overlapping a bottom portion of the second corrugated spunbond layer on a top portion of the first corrugated spunbond layer.

8. The method of claim 6, wherein the second combination rainscreen and lath assembly is horizontally offset from the first combination rainscreen and lath assembly so side edges of the first combination rainscreen and the second combination rainscreen are not aligned.

9. The method of claim 6, wherein at least one of the first combination rainscreen and lath assembly and the second combination rainscreen and lath assembly includes a corrugated spunbond layer that is at least partially perforated.

10. The method of claim 6, wherein at least one of the first combination rainscreen and lath assembly and the second combination rainscreen and lath assembly includes a corrugated lath layer.

* * * * *